US009483014B2

(12) United States Patent
Fujikawa

(10) Patent No.: US 9,483,014 B2
(45) Date of Patent: Nov. 1, 2016

(54) IMAGE FORMING APPARATUS HAVING PANEL UNIT

(71) Applicant: Brother Kogyo Kabushiki Kaisha, Nagoya-shi, Aichi-ken (JP)

(72) Inventor: Yasumasa Fujikawa, Nagoya (JP)

( * ) Notice: Subject to any disclaimer, the term of this patent is extended or adjusted under 35 U.S.C. 154(b) by 0 days.

(21) Appl. No.: 14/555,781

(22) Filed: Nov. 28, 2014

(65) Prior Publication Data

US 2015/0153700 A1 Jun. 4, 2015

(30) Foreign Application Priority Data

Nov. 29, 2013 (JP) ..... 2013-248288
Nov. 29, 2013 (JP) ..... 2013-248289

(51) Int. Cl.

| | |
|---|---|
| ***B41J 29/02*** | (2006.01) |
| ***H01H 9/04*** | (2006.01) |
| ***G03G 21/16*** | (2006.01) |
| *G03G 15/00* | (2006.01) |

(52) U.S. Cl.

CPC ..... *G03G 21/1619* (2013.01); *G03G 15/5016* (2013.01); *G03G 2215/0141* (2013.01)

(58) Field of Classification Search

CPC ..... B41J 29/02; B41J 5/105; G03G 21/1619; G03G 2221/1678; H04N 1/00496; H04N 1/00519; H04N 1/00384

See application file for complete search history.

(56) References Cited

U.S. PATENT DOCUMENTS

| | | | | |
|---|---|---|---|---|
| 7,484,722 | B2 | 2/2009 | Ishii | |
| 7,748,706 | B2 | 7/2010 | Ishii | |
| 7,995,948 | B2 | 8/2011 | Yano et al. | |
| 8,155,556 | B2 | 4/2012 | Moribe et al. | |
| 8,204,401 | B2 | 6/2012 | Tsuchiya | |
| 2006/0008294 | A1 | 1/2006 | Ito et al. | |
| 2006/0269320 | A1 | 11/2006 | Ishii | |
| 2007/0002290 | A1 | 1/2007 | Muraki et al. | |
| 2007/0036604 | A1 | 2/2007 | Maekawa et al. | |
| 2008/0014007 | A1* | 1/2008 | Ukai | B41J 29/02 400/691 |
| 2008/0049260 | A1 | 2/2008 | Moribe et al. | |
| 2008/0224385 | A1* | 9/2008 | Takahira | B65H 5/062 271/225 |

(Continued)

FOREIGN PATENT DOCUMENTS

| | | | |
|---|---|---|---|
| JP | H03-217861 | A | 9/1991 |
| JP | 2002-137493 | A | 5/2002 |
| JP | 2002-182441 | A | 6/2002 |

(Continued)

OTHER PUBLICATIONS

May 22, 2015—(US) Notice of Allowance—U.S. Appl. No. 14/547,608.

(Continued)

*Primary Examiner* — Matthew G Marini
*Assistant Examiner* — Ruben Parco, Jr.
(74) *Attorney, Agent, or Firm* — Banner & Witcoff, Ltd.

(57) ABSTRACT

An image forming apparatus which is provided with a casing, a panel unit provided with at least one of an operation unit acquiring an operation to control the image forming apparatus and a display unit, a discharge tray configured to receive a recording medium discharged from the casing. The casing has a first cover arranged above an image forming unit and constituted at least a part of an upper surface of the casing. The first cover includes a tray part which is at least a part of the discharge tray, a surrounding part configured to surround the tray part. The panel unit is arranged to be inserted in the surrounding part.

20 Claims, 13 Drawing Sheets

(56) References Cited

U.S. PATENT DOCUMENTS

| | | | |
|---|---|---|---|
| 2009/0116889 | A1 | 5/2009 | Ishii |
| 2013/0272744 | A1 | 10/2013 | Wakayama et al. |

FOREIGN PATENT DOCUMENTS

| | | | | | |
|---|---|---|---|---|---|
| JP | 2002-351282 | A | | 12/2002 | |
| JP | 2005-018011 | A | | 1/2005 | |
| JP | 2006-053508 | A | | 2/2006 | |
| JP | 2006-337570 | A | | 12/2006 | |
| JP | 2006337570 | A | * | 12/2006 | ..... G03G 15/00 |
| JP | 2007-062159 | A | | 3/2007 | |
| JP | 2007-292968 | A | | 11/2007 | |
| JP | 2008-052037 | A | | 3/2008 | |
| JP | 2009-169120 | A | | 7/2009 | |
| JP | 2009-169126 | A | | 7/2009 | |
| JP | 4826387 | B2 | | 11/2011 | |
| JP | 2012-203989 | A | | 10/2012 | |
| JP | 2012203989 | A | * | 10/2012 | ..... G03G 15/00 |

OTHER PUBLICATIONS

Jun. 11, 2015—(US) Notice of Allowance—U.S. Appl. No. 14/525,608.

Jun. 23, 2015—(US) Notice of Allowance—U.S. Appl. No. 14/553,116.

Apr. 10, 2015—(US) Non-Final Office Action—U.S. Appl. No. 14/538,304.

* cited by examiner

FIG. 11A
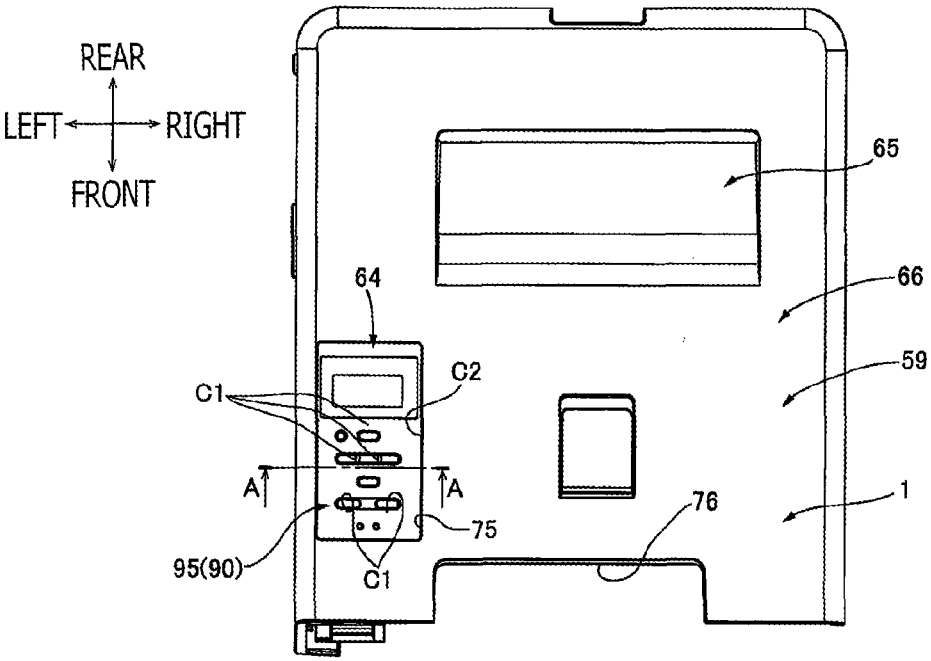
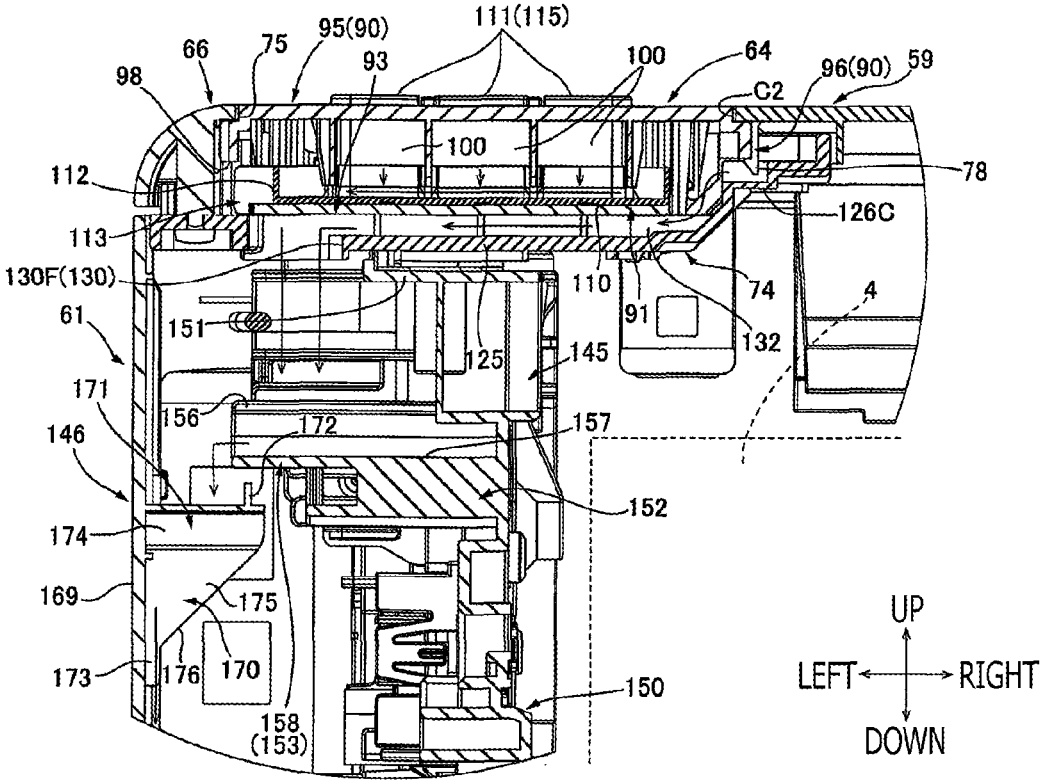
FIG. 11B

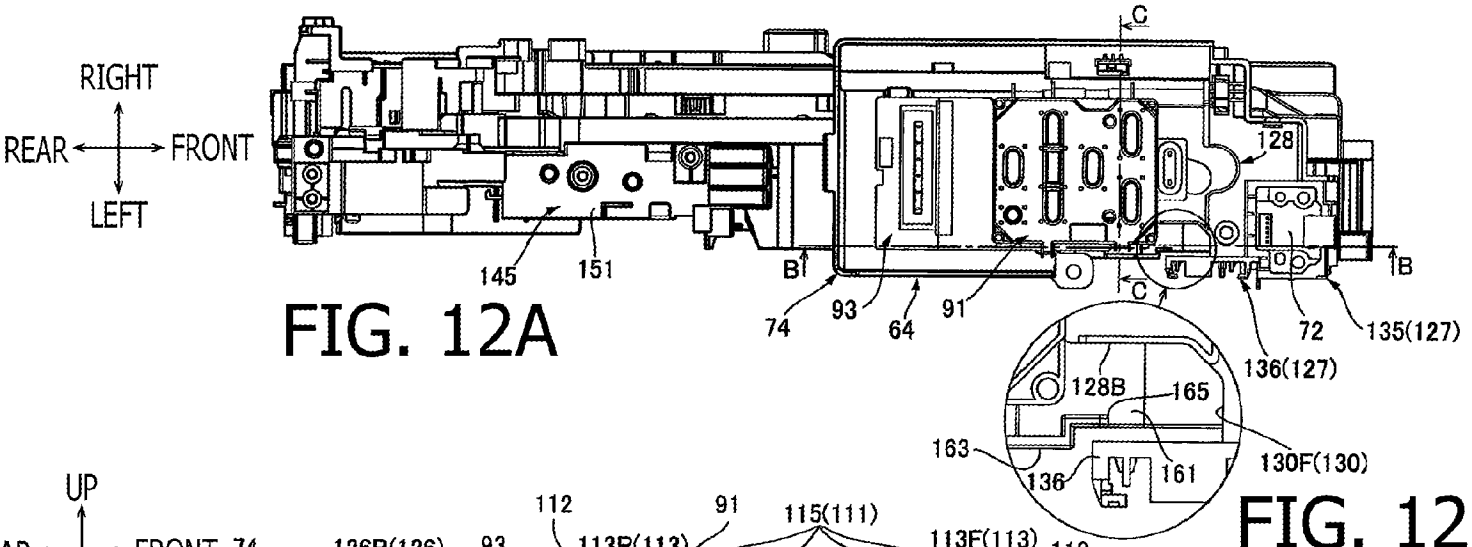
FIG. 12A
FIG. 12C
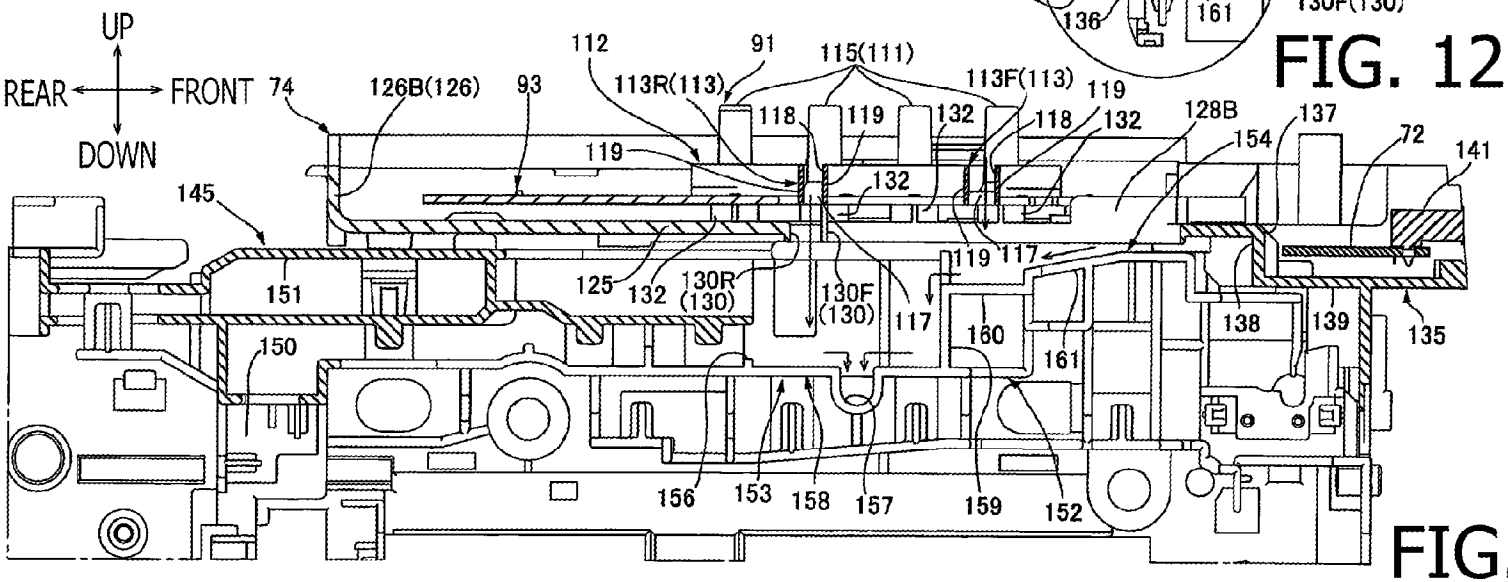
FIG. 12B

IMAGE FORMING APPARATUS HAVING PANEL UNIT

CROSS-REFERENCE TO RELATED APPLICATION

This application claims priority under 35 U.S.C. §119 from Japanese Patent Applications No. 2013-248288 and No. 2013-248289 both filed on Nov. 29, 2013. The entire subject matters of the applications are incorporated herein by reference.

BACKGROUND

1. Technical Field

The present disclosures relate to an image forming apparatus provided with a panel unit.

2. Related Art

Electrophotographic Image Forming Apparatus have been widely used. Such an electrophotographic printer is generally provided with a decorative cover and a control panel. Typically, the control panel is integrally provided to the decorative cover.

SUMMARY

The control panel is generally provided with an operation unit including a plurality of buttons and/or touch panel, and a display unit such as an LED (light emitting diode) display. The number of the buttons and an arrangement of the buttons, touch panel and LED display may be changed depending of the types/functions of the image forming apparatus.

According to aspects of the disclosures, there is provided an image forming apparatus which is provided with a casing, a panel unit provided with at least one of an operation unit acquiring an operation to control the image forming apparatus and a display unit, a discharge tray configured to receive a recording medium discharged from the casing. The casing has a first cover arranged above an image forming unit and constituted at least a part of an upper surface of the casing. The first cover includes a tray part which is at least a part of the discharge tray, a surrounding part configured to surround the tray part. The panel unit is arranged to be inserted in the surrounding part.

BRIEF DESCRIPTION OF THE ACCOMPANYING DRAWINGS

FIG. 11A is a plan view of the printer shown in FIG. 2.

FIG. 11B is a cross sectional view of the printer taken along line A-A in FIG. 11A.

FIG. 12A is a plan view of the panel unit and the frame shown in FIG. 11B.

FIG. 12B is a cross sectional view of the panel unit and the frame shown in FIG. 12A, taken along a line B-B in FIG. 12A.

FIG. 12C is an enlarged view of a circled portion in FIG. 12A.

DETAILED DESCRIPTION OF AN ILLUSTRATIVE EMBODIMENT

1. Overall Configuration of Printer

Figure 1:
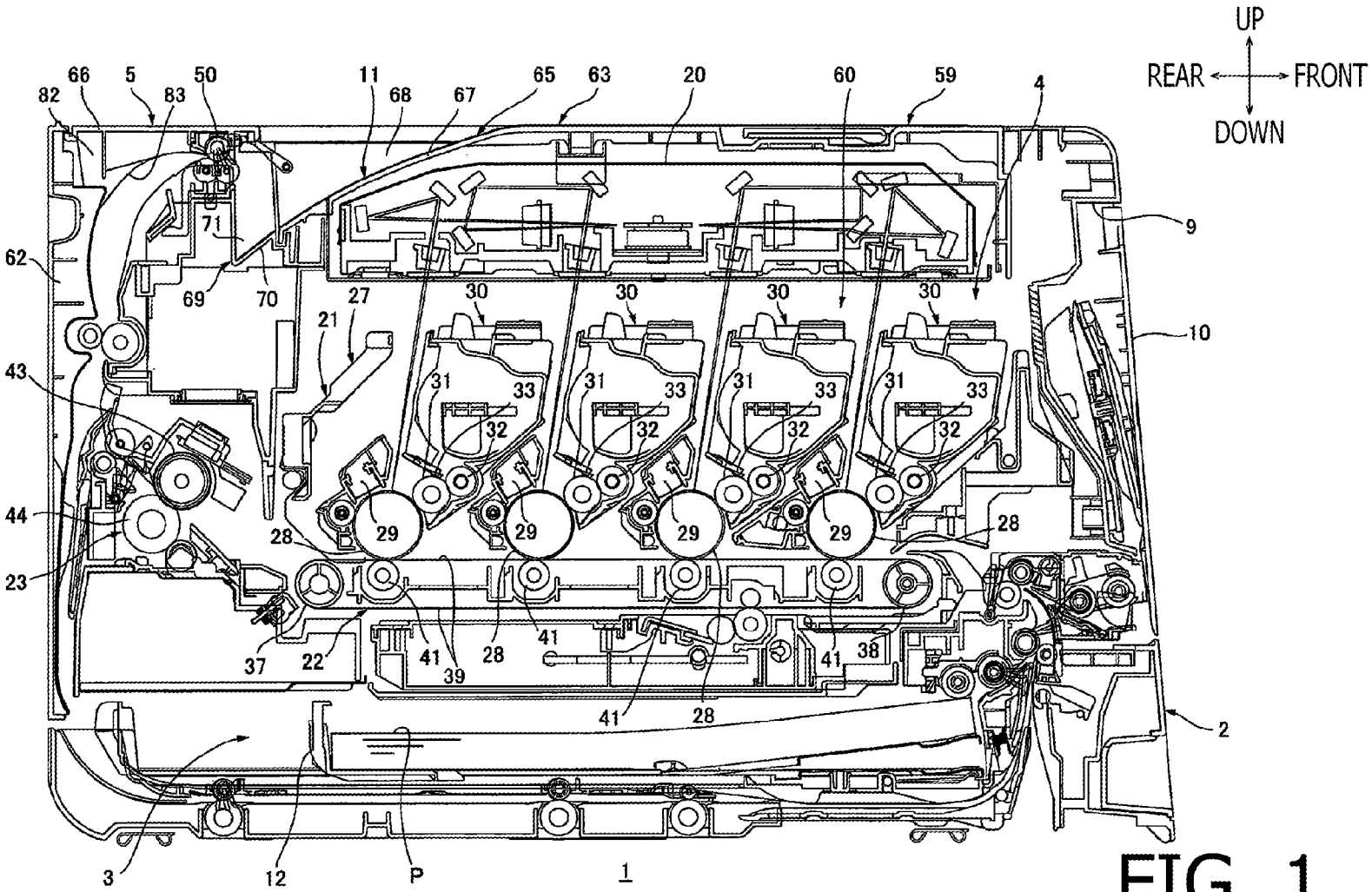
FIG. 1 is a cross-sectional side view of a printer according to an embodiment of the disclosures.

As shown in FIG. 1, a printer 1 according to an illustrative embodiment is a so-called direct tandem type color laser printer. The printer 1 has a casing 2, a sheet feeding unit 3, an image forming unit 4 and a sheet discharging unit 5.

The casing 2 has a box-like shape and accommodates the sheet feeding unit 3, the image forming unit 4 and the sheet discharging unit 5 therein.

In the following description, directions with respect to the printer 1 will be defined as follows. An up and down directions are defined based on a state where the printer is placed horizontally. That is, in FIG. 1, for example, an upside of the drawing is an upside of the printer 1, and a down side of the drawing is an downside of the printer 1. A right-hand side of FIG. 1 is a front side of the printer 1, and a left-hand side of FIG. 1 is a rear side of the printer 1. Further, right and left sides of the printer are defined when the printer 1 is viewed from the front side. Therefore, a closer side with respect to a plane of FIG. 1 is a left side of the printer 1, while a farther side with respect to a plane of FIG. 1 is a right side of the printer 1. In other words, the right-and-left direction and front-and-rear direction of the printer 1 are horizontal directions, while the up-and-down direction is a vertical direction. Based on the above definitions, directions are indicted in the other drawings.

Figure 2:
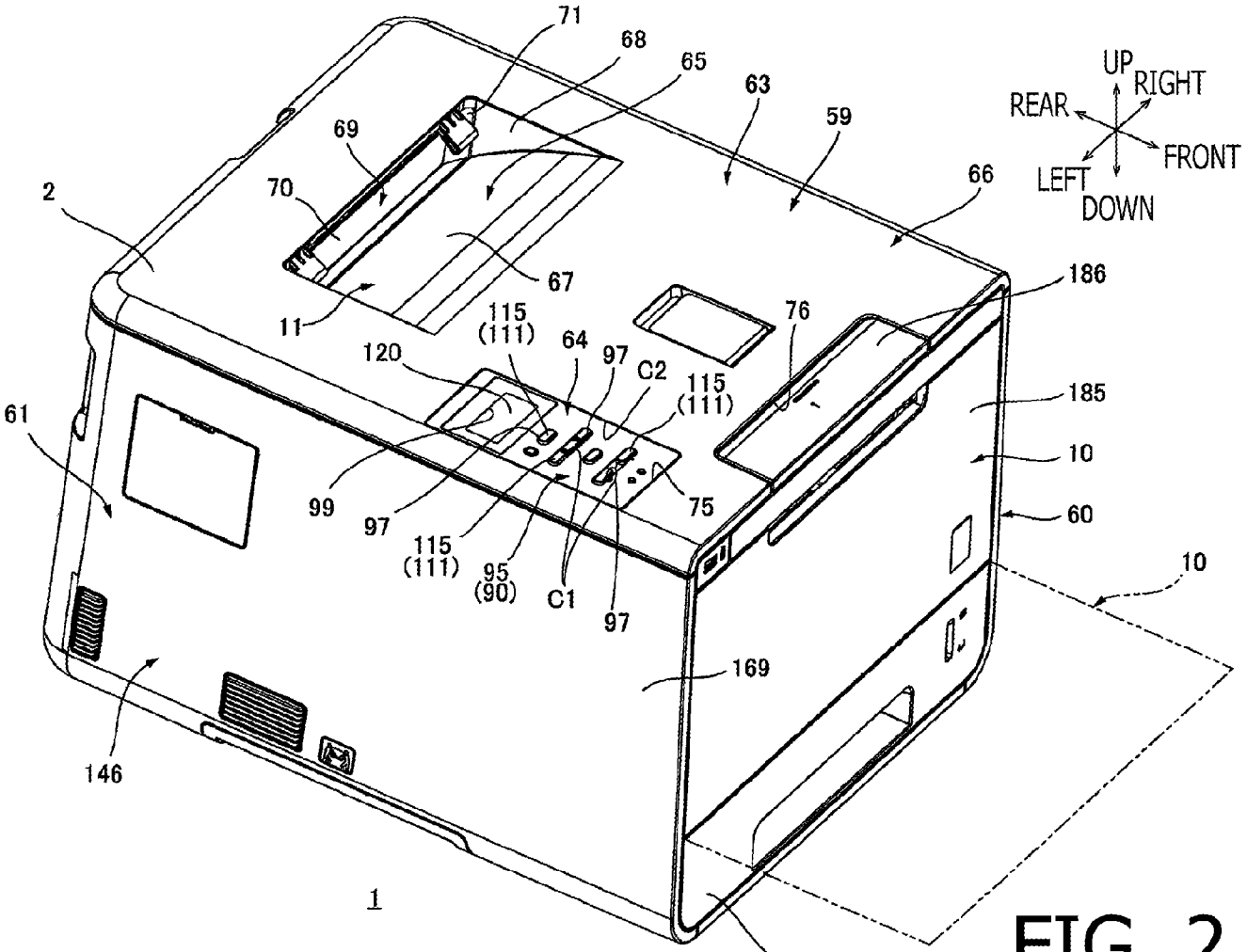
FIG. 2 is a perspective view of the printer, which is shown in FIG. 1, viewed from an upper left side thereof.

The casing 2 has an opening 9, a front cover 10 and a discharge tray 11. The opening 9 is arranged on a front end portion of the casing 2, and pierced in the front wall of the casing 2 in the front-and-rear direction. In other words, through the opening 9, an inside space of the casing 2 communicates with an external space in the front-and-rear direction. The front cover 10 is, as shown in FIG. 2, configured to rotatable, about its lower end, between a closing position at which the front cover 10 closes the opening 9 and an opening position at which the front cover 10 let the opening 9 open. In FIG. 2, the front cover 10 indicated by solid line represents the closed position thereof, while the front cover indicated by phantom lines represents the open position thereof.

The discharge tray 11 is arranged at a rear portion of an upper wall 59 of the casing 2. The discharge tray 11 is formed to be recessed downward from the upper surface of the casing 2 so that a sheet P can be stacked thereon.

The sheet feeding unit 3 is configured to feed the sheet P toward the image forming unit 4. The sheet feeding unit 3 has a sheet feed tray 12, which is detachably attached in a bottom portion of the casing 2 and accommodates a plurality of sheets P in a stacked manner.

The image forming unit 4 is configured to form an image on a sheet P, and provided with a scanner unit 20, a process unit 21, a transfer unit 22 and a fixing unit 23.

The scanner unit 20 is arranged at an upper portion inside the casing 2. The scanner unit 20 is configured to emit a laser beam, which is modified based on image data, to each of a plurality of photoconductive drums 28 (described later).

The process unit 21 is arranged at a substantially central portion in the up-and-down direction inside the casing 2, and is arranged below the scanner unit 20. The process unit 21 is configured to be slidable in the front-and-rear direction, and configured to be drawn out of the casing 2 through the opening 9. The process unit 21 has a drawer unit 21 and developer cartridges 30.

The drawer unit 27 contains the plurality of photoconductive drums 28 and scorotron type chargers 29.

The plurality of photoconductive drums 28 are provided corresponding to a plurality of color components, respectively. The plurality of photoconductive drums 28 are arranged along the front-and-rear direction with certain intervals thereamong. Specifically, according to the illustrative embodiment, there are four photoconductive drums 28 for yellow, magenta, cyan and black image components, and arranged in this order from the front side to the rear side in the drawer unit 27. Each of the photoconductive drums 28 has a cylindrical shape extending in the right-and-left direction (i.e., axis of the cylinder extending in the right-and-left direction), and rotatably supported at a lower part of the drawer unit 27 so as to be exposed to the laser beam incident from below.

According to the illustrative embodiment, there are four scorotron type chargers 29 respectively corresponding to the four photoconductive drums 28. Each of the scorotron type chargers 29 is arranged on an upper rear side with respect to the corresponding photoconductive drum 28 with an clearance therebetween.

There are four developer cartridges 30 respectively corresponding to the four photoconductive drums 28. Each of the developer cartridges 30 is arranged on an upper front side with respect to the corresponding photoconductive drum 28 such that each developer cartridge 30 is detachably attached to the drawer 27. Each developer cartridge 30 is provided with a developing roller 31, a supplying roller 32 and a thickness regulating blade 33.

Each of the developing roller 31 is arranged at a lower end portion of each developer cartridge 30. A lower rear portion of the developing roller 31 is exposed to outside from the developer cartridge 30. The lower rear portion of the developing roller 31 contacts an upper front portion of the corresponding photoconductive drum 28. The supplying roller 32 is arranged on an upper front side with respect to the developing roller 31, and a lower rear portion of the supplying roller 32 contacts an upper front portion of the corresponding developing roller 31. The thickness regulating blade 33 is arranged above the developing roller 31 and contacts an upper end portion of the corresponding developing roller 31. The developer cartridges 30 contain toners of respective colors in spaced formed above the supplying rollers, respectively.

The transfer unit 22 is arranged between, in the up-and-down direction, the sheet tray 12 and the process 21, and extends in the front-and-rear direction. The transfer unit 22 contains a driving roller 37, a driven roller 38, a conveying belt 39 and a transfer roller 41. The driving roller 37 and the driven roller 38 are arranged along the front-and-rear direction with a certain interval therebetween. The conveying belt 39 is an endless belt wound around the driving roller 37 and the driven roller 38. It is noted that there are four transfer rollers 41 respectively corresponding to the four photoconductive drums 28, and arranged bellow the respective photoconductive drums 28 such that an upper part of the wounded conveying belt 39 is sandwiched by four pairs of photoconductive drums 28 and the transfer roller 41.

The fixing unit 23 is arranged on the rear side with respect to the transfer unit 22 with a certain interval therebetween. The fixing unit 23 includes a heat roller 43 and a pressure roller 44. An upper front portion of the heat roller 44 is press-contacted to a lower rear portion of the heat roller 43.

The sheet discharging unit 5 is configured to discharge each sheet P on which an image is formed by the image forming unit 4 out of the casing 2. The sheet discharging unit 5 is arranged on an upper side with respect to the fixing unit 23, and is provided with a discharging roller 50. The discharging roller 50 is rotatably supported by the casing 2 and is arranged on a rear side with respect to the sheet discharge tray 11.

In the printer 1 configured as above, under control of a control unit (not shown), an image forming operation proceeds as follows. Initially, the scorotron type chargers 29 uniformly charge circumferential surfaces of the photoconductive drums 28. Then, the charged circumferential surfaces of the photoconductive drums 28 are exposed to the laser beams emitted by the scanner unit 20 based on the image data, respectively. As exposed to the laser beams, electrostatic latent images are formed on the circumferential surfaces of the photoconductive drums 28, respectively.

In each developer cartridge 30, the toner is supplied to the supplying roller 32, then the supplying roller 32 supplies the toner to the developing roller 31. During transferring of the toner from the supplying roller 32 to the developing roller 31, the toner is frictionally-charged to a positively. The tonner supplied onto the developing roller 31 is regulated to have a predetermined thickness by the thickness regulating blade 33. As the developing roller 31 rotates 31, the toner the developing roller 31 carries is supplied onto the latent image formed on the circumferential surface of the corresponding photoconductive drum 28. As a result, the latent image is developed to a toner image, which is carried by the circumferential surface of the photoconductive drum 28.

The sheets P accommodated in the sheet feed tray 12 are supplied one by one at every predetermined timing toward a position between the photoconductive drums 28 and the conveying belt 39 as various rollers rotate. The conveying belt 39 conveys the sheet P supplied between the photoconductive drums 28 and the conveying belt 39 from rear side to the front side. At this stage, the photoconductive drums 28 and the transfer rollers 41 sequentially forms images of respective color components on the sheet P conveyed by the conveying belt 39, thereby a color image is formed on the sheet P.

The sheet P on which the color image has been formed is conveyed, as the conveying belt 39 proceeds, to a nip between the heat roller 43 and the pressure roller 44. The heat roller 43 and the pressure roller 44 apply heat and pressure to the sheet P passing through the nip therebetween, thereby the color image having been transferred on the sheet P is fixed onto the sheet P. Thereafter, the sheet P is guided by a guiding ribs 82 of the conveying guide and conveyed to the discharge roller 50. The discharge roller 50 conveys the sheet from the rear side to the front side, and discharges the sheet P onto the sheet discharge tray 11. The discharged sheet P is stacked on top of the sheets P having been stacked on the discharge sheet tray 11.

2. Casing

The casing 2 has, as shown in FIGS. 1 and 2, an upper wall 59, a left wall 61, a right wall 60, a rear wall 62 and a front cover 10.

The upper wall 59 is provided above the image forming unit 4 as shown in FIG. 1.

Figure 4:
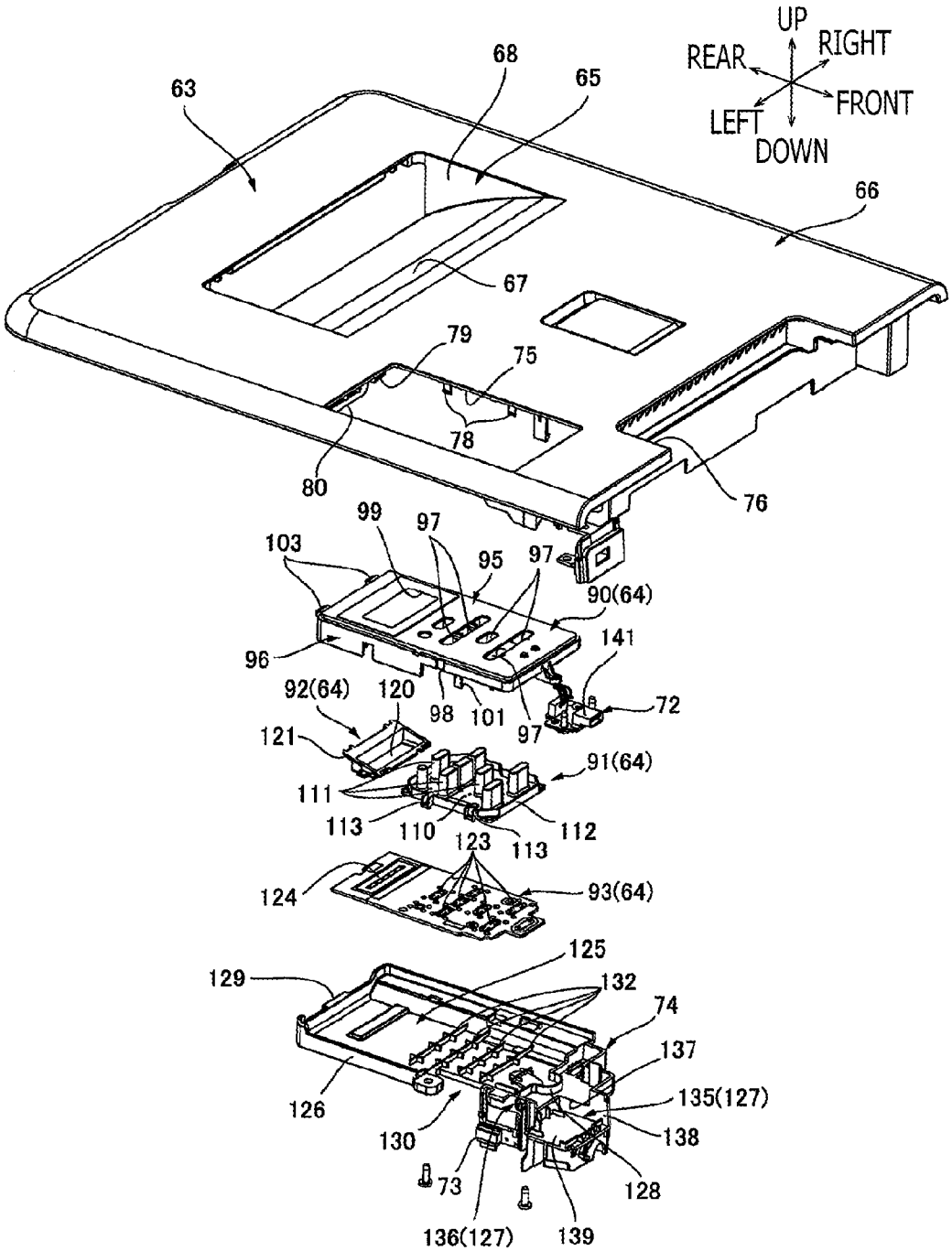
FIG. 4 is an exploded perspective view of the upper wall shown in FIG. 3, viewed from an upper left side thereof.
Figure 6A:
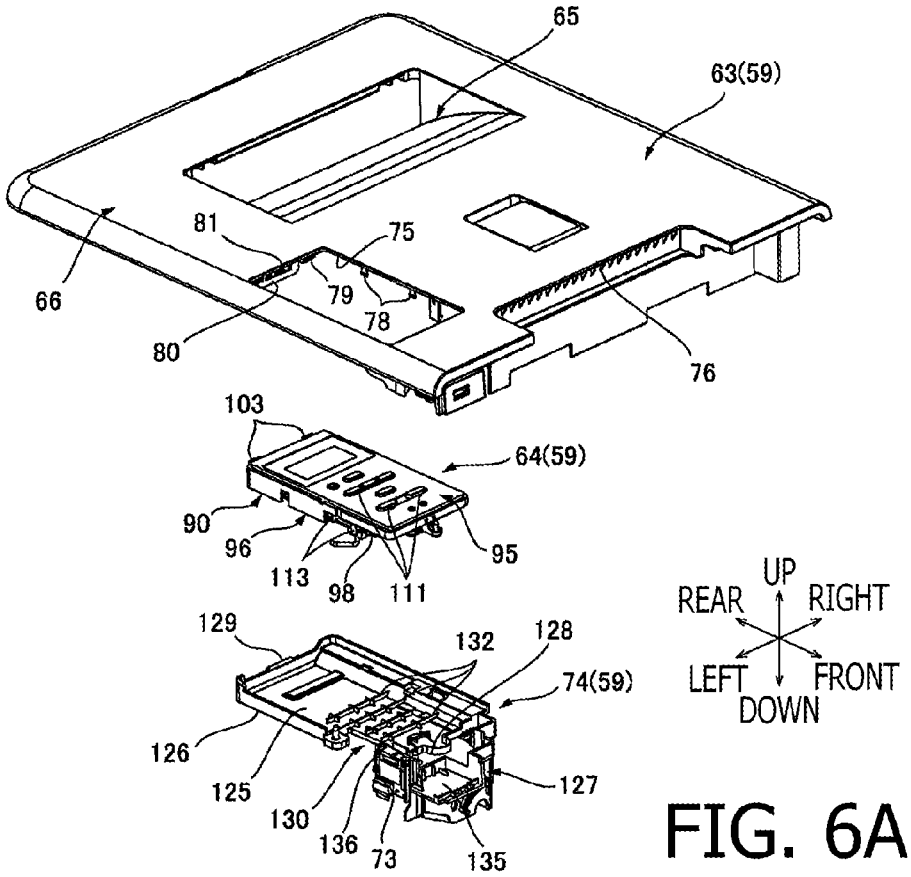
FIG. 6A is a perspective view of a top cover, a panel unit and a panel cover shown in FIG. 4, viewed from an upper left side thereof.

The upper wall 59 has, as shown in FIGS. 4 and 6A, a top cover 63, a panel unit 64, a panel cover 74, a USB (universal serial bus) substrate 72 and a communication substrate 73.

The top cover 63 has a plate-like member having a substantially rectangular plan view, a tray part 65 and a surrounding part 66, which are formed integrally.

The tray part 65 is arranged, when viewed in the up-and-down direction, at a central portion in the right-and-left direction at the rear portion of the top cover 63, and formed to be recessed downward from the top surface of the top cover 63. Specifically, the tray part 65 is formed with a sheet placing part 67 and a pair of side walls 68.

The sheet placing part 67 is a bottom part of the tray part 65, and is a plate-like member having a substantially rectangular plan view extending in the right-and-left direction. The sheet placing part 67 extends from the surrounding part 66, as shown in FIG. 1, and is inclined downward as it is advanced to the rear side thereof. The pair of side walls 68 connect the right and left ends of the sheet placing part 67 with the surrounding part 66 in the up-and-down direction. With this configuration, the pair of side walls 68 are arranged in the right-and-left directions to face each other with a certain interval therebetween in the right-and-left direction.

The tray unit 64 constitutes a sheet discharge tray 11 together with an inner chute 69 provided to the printer 1, as shown in FIG. 1. The inner chute 69 has a bottom part 70 and a pair of side parts 71. The bottom part 70 is a plate-like portion and substantially L-shaped when viewed in the right-and-left direction. The bottom part 70 extends in the right-and-left direction. A rear part of the bottom portion 70 extends in the up-and-down direction, and a front part of the bottom portion 70 extends toward an upper-front direction, connected from the lower end of the rear part of the bottom portion 70. The pair of side parts 71 are arranged in the right-and-left direction with a certain interval therebetween and face each other. The side parts 71 are plate-like parts each having a substantially rectangular side view extending in the up-and-down direction, and connected to the end portion in the right-and-left direction. The inner chute 69 is secured to the casing 2 such that the front part of the bottom portion 70 is located on the lower rear side of the sheet placing part 67, and the pair of side parts 71 are arranged on the rear side of the pair of side walls 68, respectively. With this configuration, the tray part 65 and the inner chute 69 configure the sheet discharge tray 11.

The surrounding part 66 is an O-shaped part, when viewed from the above, which surrounds the tray part 65 as shown in FIG. 11A. The surrounding part 66 has, as shown in FIG. 4, a panel exposing opening 75 and a recessed part 76.

The panel exposing opening 75 is arranged on a front side of a left portion of the surrounding part 66, and is arranged on a front-left side with respect to the tray part 65. The panel exposing opening 75 is an opening pierced in the surrounding part 66 so as to extend between an interior of the surrounding part and an exterior of the surrounding part.

The recessed part 76 is arranged substantially at a central position, in the right-and-left direction, of a front end of the surrounding part 66. The recessed part 76 is arranged on a right-front side with respect to the panel exposing opening 75. The recessed part 76 has a U-shaped plan view, opened toward the front side, and recessed rearward from the front end of the surrounding part 66.

Figure 5:
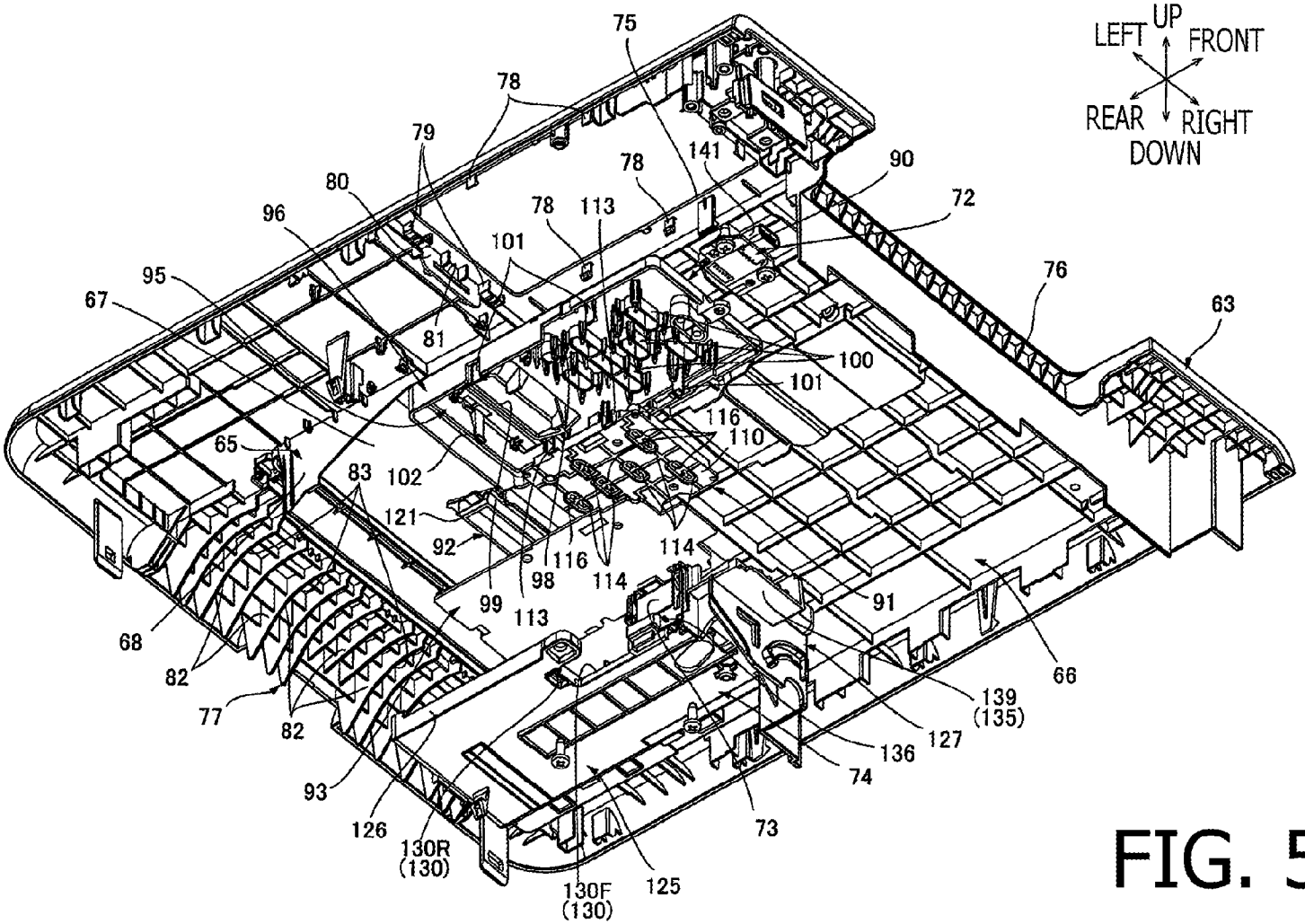
FIG. 5 is an exploded perspective view of the upper wall shown in FIG. 3, viewed from a lower left side thereof.

The surrounding part 66 has, as shown in FIG. 5, a plurality of snap-fits 78, a pair of cover engaging parts 79, an engaging board 80 and a conveying guide 77, integrally on a lower surface thereof.

Specifically, according to the illustrative embodiment, there are four snap-fits 78 on right and left peripheral portions (two for each) of the panel exposing opening 75, on the lower surface of the surrounding part 66. The two snap-fits 78 arranged on the left side with respect to the panel exposing opening 75 are space from each other in the front-and-direction. Similarly, the two snap-fits 78 arranged on the right side with respect to the panel exposing opening 75 are spaced from each other in the front-and-rear direction.

Each of the snap-fits 78 has a plate-like member having a rectangular shape when viewed in the right-and-left direction and extending in the up-and-down direction, and extending downward from the lower surface of the surrounding part 66. Each snap-fit 78 is configured to be elastically deformed to bend in the right-and-left direction. The lower end of each snap-fit 78 has a hook-shape cross section protruding inward in the right-and-left direction.

The pair of cover engaging parts 79 are arranged at rear part of the peripheral portion of the panel exposing opening 75 on the lower surface of the surrounding part 66, and arranged to be spaced from each other in the right-and-left direction. The cover engaging part 79 has a substantially U-shape front view which is opened upward, and extends in the front-and-rear direction. The upper end part of the cover engaging part 79 is connected to the lower surface of the surrounding part 66.

The engaging board 80 is arranged on a rear peripheral portion of the panel exposing opening 75 on the lower surface of the surrounding part 66, between, in the right-and-left direction, the pair of cover engaging parts 79. The engaging board 80 is a plate-like member having a substantially rectangular front view extending in the right-and-left direction, and protruding downward from the lower surface of the surrounding part 66. The size of the engaging board 80 in the up-and-down direction is larger than the size of the cover engaging part 79 in the up-and-down direction.

The engaging board 80 has an engaging hole 81 which is arranged at a substantially central position of the engaging board when viewed from the front side. The engaging hole 81 is formed to have a rectangular shape extending in the right-and-left direction when viewed from the front side. Further, the engaging hole 81 is pierced in the engaging board 80 in the front-and-rear direction.

The conveying guide 77 is arranged at a substantially central position, in the right-and-left direction, on the rear side of the lower surface of the surrounding part 66. The conveying guide 77 is provided with a plurality of guide ribs 82. The plurality of guide ribs 82 are arranged in parallel along the right-and-left direction with certain intervals thereamong. Each of the guide ribs 82 is a plate-like member having a substantially rectangular side view extending in the front-and-rear direction and protrudes downward from the lower surface of the surrounding pat 66 as shown in FIG. 1. Each guide ribs 82 has a curved side 83, which is a lower side of the guide rib 82 and having a curved shape, when viewed from the right-and-left direction, recessed toward the upper rear side.

The panel unit 64 has a panel frame 90, a rubber key 91, a display unit 92 and a panel substrate 93.

The panel frame 90 has a panel plate 95 and a stepped part 96. The panel plate 95 is a plate-like member having a rectangular plan view extending in the front-and-rear direction, and having substantially the same size as the panel exposing opening 75.

The panel plate 95 has a plurality of button holes 97 and a display hole 99. The plurality of button holes 97 correspond to the plurality of buttons 111 provided to the rubber key 91, and formed on a front portion of the panel plate 95 so as to have certain spaces thereamong. Each of the button holes 97 has an oval plan view extending in the right-and-left direction or rectangular plan view extending in the right-and-left direction, and is pierced in the panel plate 95 in the up-and-down direction. The display hole 99 is arranged on a rear portion of the panel plate 95. The display hold 99 has a rectangular plan view extending in the right-and-left direction and is pierced in the panel plate 95 in the up-and-down direction.

The panel plate4 95 is integrally provided with a plurality of button collars 100, a plurality of first hook parts 101 and a second hook part 102 on the lower surface thereof, as shown in FIG. 5.

The plurality of button collars 100 are provided respectively corresponding to the plurality of button holes 97, and arranged on the lower surface of the panel plate 95, on the front part thereof. Each of the button collars 100 has a cylindrical shape extending in the up-and-down direction, and extending downward from the periphery of the corresponding button hole 97. Further, the shape of each of the button collar 100 when viewed from the below is substantially the same as the shape of the corresponding button hole 97.

Specifically, the plurality of first hook parts 101 are arranged such that two first hook parts 101 are arranged on each of the right and left end portions of the lower surface of the panel plate 95. The first hook parts 101 arranged on the left side portion of the lower surface of the panel plate 95 are arranged to be spaced from each other in the front-and-rear direction, and the first hook parts 101 arranged on the right side portion of the lower surface of the panel plate 95 are arranged also to be spaced from each other in the front-and-rear direction.

Each of the first hook parts 101 is a plate-like member having a rectangular side view extending in the up-and-down direction, and extends downward from the lower surface of the panel plate 95. Further, the lower end of each first hook part 101 has a hook-shaped cross section protruding inward in the right-and-left direction.

The second hook part 102 is arranged at a substantially central position, in the right-and-left direction, of a rear portion of the lower surface of the panel plate 95, and arranged on the rear peripheral portion of the display hold 99. The second hook part 102 is a plate-like member having a substantially rectangular rear view extending in the up-and-down direction, and extends downward from the lower surface of the panel plate 95. The second hook part 102 is configured to be elastically deformed to bend in the front-and-rear direction. Further, the lower end of the second hook part 1012 has a hook-like shape protruding frontward. The size, in the up-and-down direction, of the second hook part 102 is substantially the same size as the size, in the up-and-down direction, of the first hook part 101.

The stepped part 96 is formed to protrude downward from the entire peripheral of the panel plate 50. Thus, the panel frame 90 has a cross section take along the right-and-left direction or the front-and-rear direction is U-shaped opening toward the down side.

The stepped part 96 has a clank-like cross-section as shown in FIG. 11B. The stepped part 96 protrudes downward from the periphery of the panel plate 95.

The stepped part 96 has a cutout part 98 and a pair of panel engaging parts 103 as shown in FIG. 4.

The cutout part 98 is formed at a lower front part of the left wall of the stepped part 96. The cutout part 98 has a rectangular side view extending in the front-and-rear direction, and is formed by cutting out a front portion of a lower end of the left wall of the stepped part 96 upwardly.

The pair of panel engaging parts 103 are provided corresponding to the pair of cover engaging parts 79, and arranged on a rear surface of the rear wall of the stepped part 96. The pair of panel engaging parts 103 face each other in the right-and-left direction with a certain space therebetween. Each of the panel engaging parts 103 protrudes rearward from the rear surface of the rear wall of the stepped part 96.

The rubber key 91 is arranged below the front portion of the panel plate 95. The rubber key 91 is made of rubber, and has a planar part 110, a plurality of buttons 111, a peripheral wall 112 and an extending part 113.

The planar part 110 is a plate-like part having a rectangular plan view. In other words, the planar part 110 extends in the front-and-rear direction, and in the right-and-left direction. As won in FIG. 5, the planar part 110 has a plurality of through holes 114, which correspond to the plurality of buttons 111. Each of the plurality of through holes 114 has an oval shape extending in the right-and-left direction or a rectangular shape extending in the right-and-left direction, and is pierced in the planar part 110 in the up-and-down direction.

Figure 8:
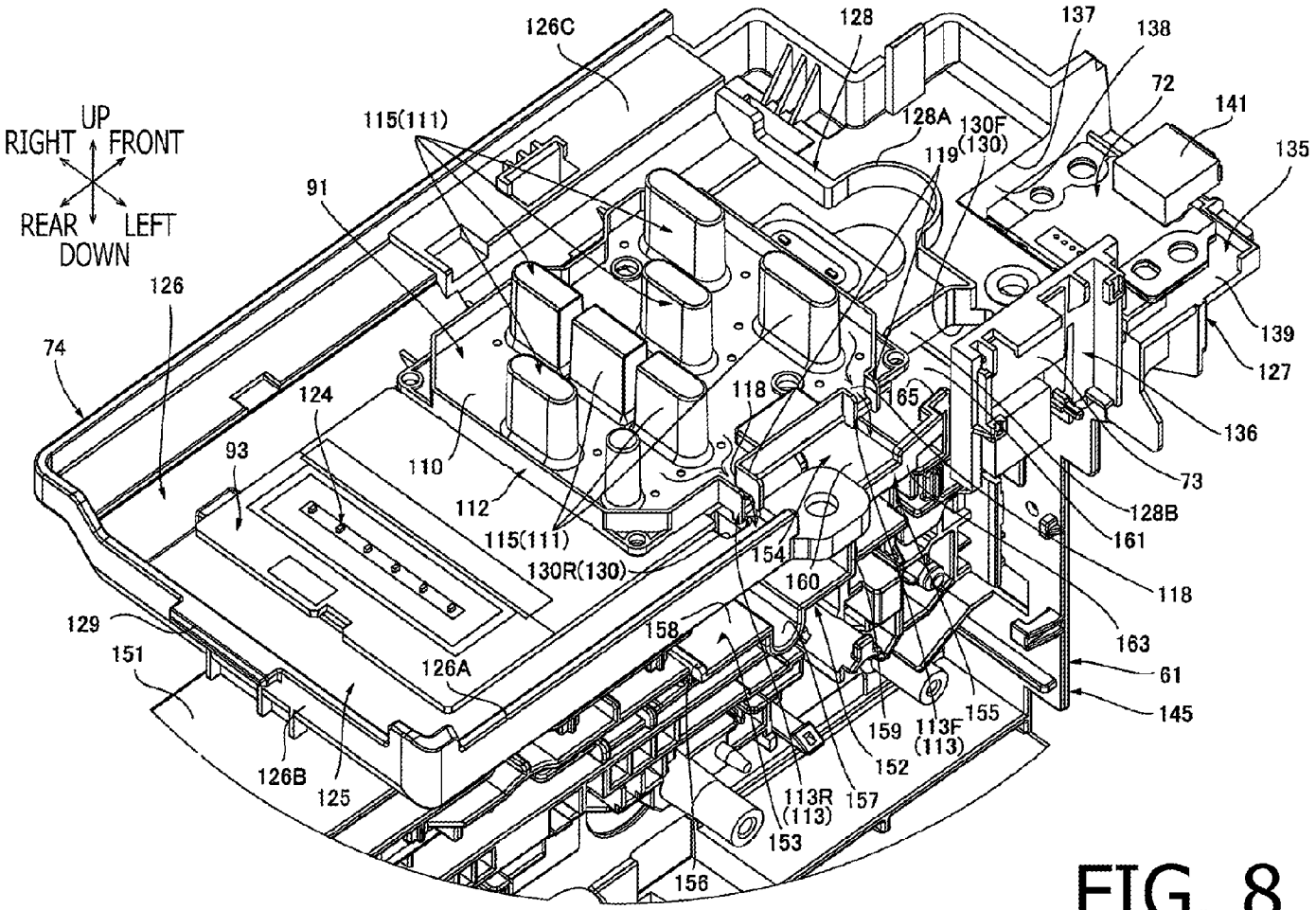
FIG. 8 is a perspective view of the panel unit and the panel cover shown in FIG. 6A with removing a panel frame, viewed from an upper left side thereof.

As shown in FIG. 8, the plurality of buttons 111 are arranged on an upper surface of the planar part 110. Each button 111 includes, as shown in FIGS. 5 and 8, a button body 115 and a conductive member 116.

The button body 115 has a cylindrical shape extending in the up-and-down direction, as shown in FIG. 8, and extends upward from the peripheral portion of the corresponding through hole 114. A shape, in plan view, of each button body 115 is substantially the same as that of the corresponding through hole 114, the upper end of the button body 115 being closed.

The conductive member 116 is made of conductive rubber and accommodated in each button body 115 as shown in FIG. 5.

The peripheral wall 112 protrudes upward from an entire periphery of the planar part 110 as shown in FIG. 8. Thus, a cross sectional view of the planar part 110 and the peripheral wall 112 form, when taken along the right-and-left and front-and-rear directions, a U shape opening toward the upside.

The peripheral wall 112 has a plurality of vents 118. According to the illustrative embodiment, there are two vents 118, which are arranged on a right wall of the peripheral wall 112 in the front-and-rear direction with a certain space therebetween. Each vent 118 has a substantially rectangular shape, when viewed in the right-and-left direction, extending in the up-and-down direction, as shown in FIG. 12B, and extends along an entire length, in the up-and-down direction, of the peripheral wall 112. That is, each vent 118 is a slit portion and is pierced in the right wall of the peripheral wall 112 in the right-and-left direction.

There are a plurality of extending parts 113. According to the illustrative embodiment, corresponding to the vents 118, two extending parts 113 are provided, which are arranged along the front-and-rear direction with a certain space therebetween. In the following description, when the two extending parts 113 are described separately, the front side extending part 113 will be referred to as a front extending part 113F, and the rear one will be referred to as a rear extending part 113R.

Each of the extending parts 113 is U shaped opened toward the upside as shown in FIG. 12B. The extending parts 113 protrude leftward from the front periphery, the rear periphery and the lower periphery of the vents 118 as shown in FIG. 8.

Figure 13:
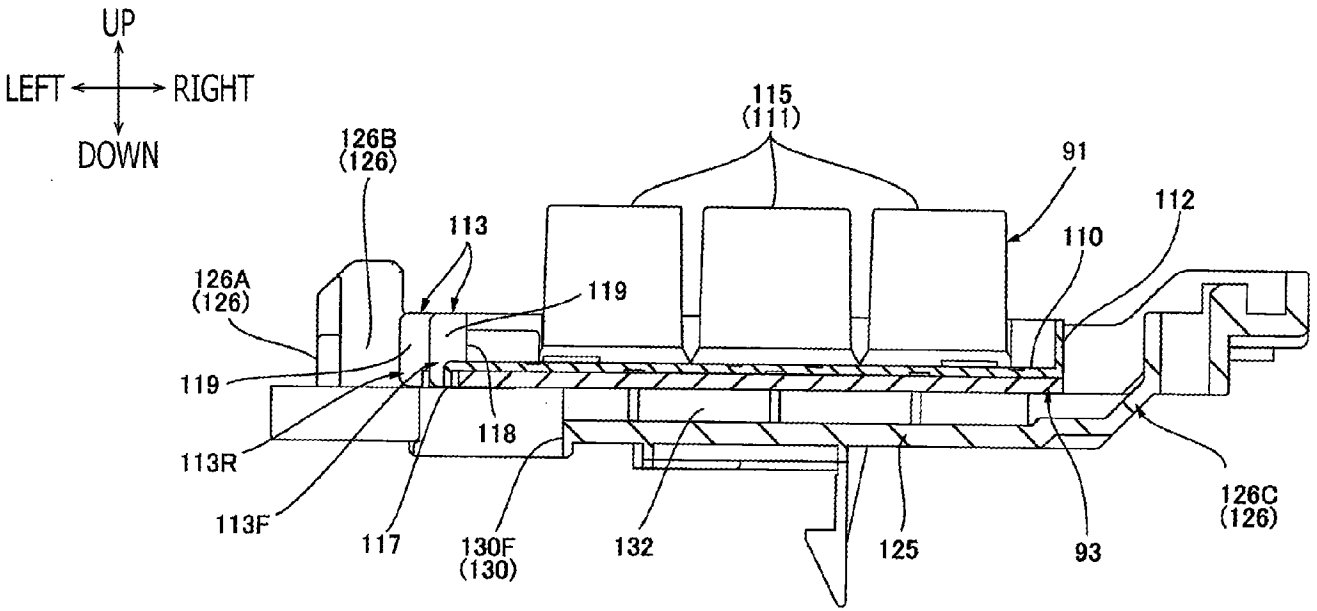
FIG. 13 is a cross sectional view of the panel unit and frame shown in FIG. 12A, taken along a line C-C in FIG. 12A.

Specifically, each of the extending part 113 has a pair of extending side parts 119 and an extending bottom part 117 as shown in FIGS. 8 and 13. As shown in FIG. 8, the pair of extending side parts 119 are front and rear side parts of the extending parts 113 and face each other along the front-and-rear direction with a certain space therebetween. The pair of extending side parts 119 are configured such that each has a plate-like shape having a substantially rectangular side view, and protrude leftward from the front and rear peripheries of the vents 118, respectively.

The extending bottom part 117 is a lower end of the extending part 113, and is bridged between the lower end portions of the pair of the extending side parts 119 as shown in FIG. 13. The extending bottom part 117 is a plate-like part having an L-shaped side view. The extending bottom part 117 extends leftward from the lower periphery of the vent 118, and bent on a right side with respect to the left end part of the extending side part 119 and extends toward the lower side. That is, the extending side parts 119 are arranged on the left side, in the right-and-left direction, with respect to the extending bottom part 117.

The display unit 92 is arranged on the lower side with respect to the rear part of the panel plate 95 as shown in FIG. 4. The display unit 92 has a supporting frame 121 and an LED (light emitting diode) display 120.

The supporting frame 121 has a rectangular column shape extending upward. The supporting frame 121 has a rectangular plan view which extends in the right-and-left direction, and a trapezoidal side view which becomes narrower toward the front side.

The LED display 120 is a displaying device provided with a plurality of light emitting diodes arranged in the right-and-left and front-and-rear directions, and configured to display an operation status of the printer 1. The LED display 120 is a plate-like device having a rectangular plan view extending in the right-and-left direction. The LED display 120 is supported by the supporting frame 121 therein.

The panel substrate 93 is arranged below the rubber key 91 and the display unit 92, and electrically connected to a control unit including CPU and the like provided to the printer 1. The panel substrate 93 is configured to transmit electrical signals transmitted from the CPU (not shown) corresponding to the operation of the image forming unit 4 and transmits the same to the LED display 120. The panel substrate 93 is also configured to transmit electrical signals corresponding to operations of the buttons 111 of the rubber key 91 to the CPU (not shown).

The panel substrate 93 has a plate-like shape having a rectangular plan view extending in the front-and-rear direction, and having a plurality of button contacts 123 and LED contacts 124. The plurality of button contacts 123 corresponding to the plurality of buttons 111 and arranged at a front portion on the upper surface of the panel substrate 93. The plurality of button contacts 123 are arranged to apart from each other by a certain space. The LED contacts 124 correspond to the LED display 120 and arranged at a rear portion on the upper surface of the panel substrate 93.

The panel cover 74 is arranged below the panel unit 64 as shown in FIG. 6A. The panel cover 74 has a sufficient size to cover the panel unit 64 from below as seen in the bottom view shown in FIG. 7.

The panel cover 74 has a cover plate 125, a spacer 132, a cover peripheral wall 126, a fitting protrusion 129, a regulating wall 128 and a substrate arranging part 127.

The cover plate 125 is a plate-like part having a substantially rectangular plan view extending in the front-and-rear direction. The cover plate 125 has liquid vents 130 and a cutout part 137.

A plurality of liquid vents (e.g., drain grooves) 130 are provided corresponding to the plurality of extending parts 113. According to the illustrative embodiment, there are two liquid vents 130. In the following description, when the two liquid vents are described separately, the front liquid vent 130 will be referred to as a front liquid vent 130F, and the rear liquid vent 130 will be referred to as a rear liquid vent 130R.

The rear liquid vent 130R is arranged at a substantially central position, in the front-and-rear direction, at the left portion of the cover plate 125. The rear liquid vent 130R has a substantially rectangular plan view and is pierced in the cover plate 125 in the up-and-down direction.

The front liquid vent 130F is arranged at the left portion of the cover plate 125, with slightly spaced rearward from the rear liquid vent 130R. The front liquid vent 130F has a substantially rectangular plan view extending in the front-and-rear direction, and recessed rightward from the left side end of the cover plate 125. That is, the front liquid vent 130F is pierced in the cover plate 125 in the up-and-down direction.

The cutout part 137 is arranged at the left portion of the cover plate 125 with being spaced frontward with respect to the front liquid vent 130F. The cutout part 137 is formed to cut out the front end part of the left portion of the cover plate 125 such that the cutout part has a substantially rectangular shape when viewed in the up-and-down direction.

A plurality of spacers 132 are arranged at a central portion, in the front-and-rear direction, on the upper surface of the cover plate 125 as shown in FIG. 4. According to the illustrative embodiment, the plurality of spacers 132 are arranged along the front-and-rear direction with being spaced from each other. Each spacer 132 has a plate-like shape having a substantially rectangular front view extending in the right-and-left direction, and protrudes upward from the upper surface of the cover plate 125.

The cover peripheral wall 126 has a substantially U-shaped plan view opened toward the front side as shown in FIG. 8, and protrudes from the left end, the rear end and the right end of the cover plate 125. Specifically, the cover peripheral wall 126 includes a left peripheral wall 126A, a rear peripheral wall 126B and a right peripheral wall 126C, which are integrally formed to the cover peripheral wall 126.

The left peripheral wall 126A protrudes upward from a rear portion with respect to the front liquid vent 130F at the left end of the cover plate 125, and has a plate-like shape having a substantially rectangular side view extending in the front-and-rear direction.

The rear peripheral wall 126B protrudes upward from the rear end of the cover plate 125, and has a plate-like shape having a substantially rectangular front view extending in the right-and-left direction. The left end portion of the rear peripheral wall 126B is connected with the rear end portion of the left peripheral wall 126A.

The right peripheral wall 126C has a substantially crank-like front view, which protrudes upward from the right end of the cover plate 125, bent rightward and they bent upward. The right peripheral wall 126C extends in the front-and-rear direction, and the rear end portion of the right peripheral wall 126C is connected with the right end portion of the rear peripheral wall 126B.

The fitting protrusion 129 is arranged at a substantially central part, in the right-and-left direction, on the rear surface of the rear peripheral wall 126B. the fitting protrusion 129 is a plate-like part having a substantially rectangular plan view extending in the right-and-left direction, and protrudes rearward from the rear surface of the rear peripheral wall 126B.

The regulation wall 128 is arranged on the upper surface of the cover plate 125 at a position on the front side with respect to the plurality of spacer 132 with a certain space therebetween as shown in FIG. 4. The regulation wall 128 is formed to protrude upward from the upper surface of the cover plate as shown in FIG. 8 and has a substantially L-shaped plan view.

The regulation wall 128 is integrally provided with a first regulation part 128A and a second regulation part 128B. The first regulation part 128A extends, in the right-and-left direction, from the front end part of the left surface of the right peripheral wall 126C to the front end part of the right peripheral end of the front liquid vent 130F.

The second regulation part 128B is connected from the left end part of the first regulation part 128A and extends rearward along the right peripheral portion of the front liquid vent 30F.

The substrate arrangement part 127 is, as shown in FIG. 4, a front left portion of the panel cover 74, and arranged on an opposite side with respect to the plurality of spacers 132, specifically, on the front left side with respect to the plurality of spacers 132. The substrate arrangement part 127 has a USB substrate arrangement part 135 and a communication substrate arrangement part 136.

The USB substrate arrangement part 135 is arranged on the front side with respect to the first regulation part 128A of the regulation wall 128 as shown in FIG. 8. The USB substrate arrangement part 135 integrally includes a side plate part 138 and a bottom plate part 139. The side plate part 138 is a plate-like part having an L-shaped front view, and extends downward from the right periphery and the rear periphery of the cutout part 137 of the cover plate 125. The bottom plate part 139 is a plate-like part having a substantially rectangular plan view, and the right end portion and the left end portion thereof are connected to the lower end part of the side plate part 138.

The communication substrate supporting part 136 is arranged at a position next to the USB substrate arrangement part 135 on the rear side thereof, and on the left side with respect to the second regulation part 128B of the regulation wall 128 with a space therebetween.

The communication substrate supporting part 136 is a plate-like part having a substantially rectangular side view, and configured to be capable of supporting the communication substrate 73 on the left surface of the communication substrate supporting part 136.

Figure 6B:
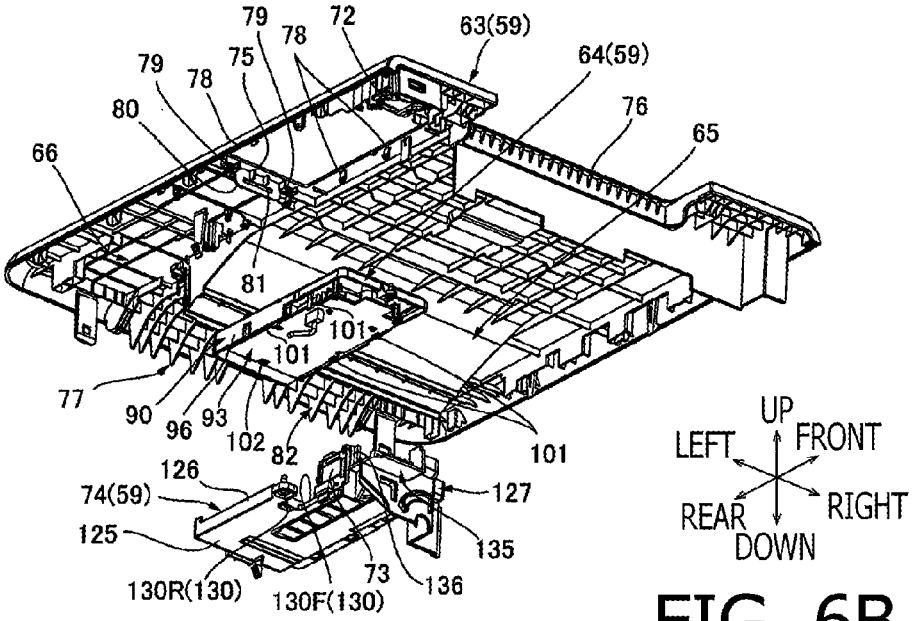
FIG. 6B is a perspective view of the top cover, the panel unit and the panel cover shown in FIG. 6A, viewed from a lower left side thereof.

The USB substrate 72 is configured to connect the printer 1 with external members, and is provided with a USB connector 141 for accepting a USB terminal of one of such external members. The USB substrate 72 is electrically connected to the CPU (not shown). The USB substrate 72 is arranged on the front side with respect to the panel exposing opening 75 and on the left side with respect to the recessed part 76 on the lower surface of the surrounding part 66 as shown in FIG. 6B.

The communication substrate 73 is configured to connect the printer 1 with a wireless LAN (local area network) so that a wireless communication is executable therebetween. The communication substrate 73 is supported on the left surface of the communication substrate supporting part 136.

Next, referring to FIGS. 4-6B, assembling of the panel unit 64 and the panel cover 74 with respect to the top cover 63 will be described. It is noted that the assembling operation describe below is performed by a worker.

In order to assemble the panel unit 64 with respect to the top cover 63, firstly the panel unit 64 itself is assembled as shown in FIGS. 4 and 5.

To assemble the panel unit 64, firstly, the rubber key 91 and the display unit 92 are attached to the panel frame 90. The rubber key 91 is attached to the front part of the panel plate 95 from below such that the button bodies 115 are inserted in the button collars 100 from below. The display unit 92 is attached to the rear part of the panel plate 95 from below such that the inner space of the supporting frame 121 communicate with the display opening 99.

Next, the panel substrate 93 is attached to the panel frame 90 from below. Then, the right and left end portions of the panel substrate 93 contact the lower ends of the four first hook parts 101, respectively, and the rear end portion of the panel substrate 93 contacts the lower end of the second hook part 102. Then, each of the four first hook parts 101 elastically deformed outward, in the right-and-left direction, and the second hook part 102 elastically deformed rearward.

Next, when the panel substrate 93 is moved upward, contacting state between the right and left end portions of the panel substrate 93 and the lower portions of the four first hook parts 101 is released, and the contacting state between the rear part of the panel substrate 93 and the lower end portion of the second hook part 102 is released.

Then, the four first hook parts 101 are re-formed by the elastic force thereof and engage with the right and left end portions of the panel substrate 93, and the second hook 102 is also elastically re-formed and engages with the rear end part of the panel substrate 93.

At this stage, the rubber key 91 is arranged between the front part of the panel plate 95 and the front part of the panel substrate 93, in the up-and-down direction, except for the upper end portion of the buttons 111 as shown in FIG. 11B.

The planar part 110 of the rubber key 91 is arranged upper next to the panel substrate 93, and each of the plurality of conductive members 116 is arranged above the corresponding button contact 123 with slightly spaced therefrom as shown in FIGS. 4 and 5.

When the user depresses the upper end part of the button 111 from above, the conductive member 116 of the depressed button 111 contacts the corresponding button contact 123, thereby the conductive member 116 and the corresponding button contacts 123 are electrically connected, and an electrical signal is output from the panel substrate 93 to the CPU (not shown). As above, by operating the buttons 111, the operation of the image forming unit 4 can be controlled.

Each of the pair of extending parts 113 is arranged to overlap the cutout part 90 when viewed from the left, as shown in FIG. 6A. The extending bottom part 117 of the extending part 113 is, as shown in FIG. 13, arranged on the left side of the panel substrate 93 with slightly spaced therefrom, and is overlapped the panel substrate 93 when viewed from the right-and-left direction. Further, a position of the lower end portion of the extending bottom part 117 is substantially the same as the position of the lower surface of the panel substrate 93 when viewed from the right-and-left direction, and arranged at substantially the same position when viewed from the up-and-down direction.

The display unit 92 is arranged, as shown in FIG. 4, between, in the up-and-down direction, the rear part of the panel plate 95 and the rear part of the panel substrate 93. The LED display 120 of the display unit 92 contacts the LED contacts 124 from above, and is arranged to overlap the display opening 99 when viewed from above.

As above, the rubber key 91, the display unit 92 and the panel substrate 93 are attached to the panel fame 90, and the panel unit 64 is assembled.

It is noted that, as shown in FIG. 2, a clearance C1 is defined between each of the inner peripheries of the button openings 97 and the outer periphery of the corresponding button body 115. In other words, there are a plurality of clearances C1 formed on the upper surface of the upper wall 59, and each clearance C1 has a substantially ring-shaped plan view.

Next, as shown in FIGS. 6A and 6B, the panel unit 64 is attached to the top cover 63.

In order to attach the panel unit 64 to the top cover 63, the panel unit 64 is inclined so that the rear part of the panel unit 64 is located at a higher position than the front part of the panel unit 64, and the panel engaging parts 103 are inserted in the pair of cover engaging parts 79 from the lower front position, respectively.

Next, the panel plate 64 is rotated counterclockwise when viewed from the left side with the panel engaging part 103 being a fulcrum so that the panel plate 95 of the panel frame 90 is inserted in the panel exposing opening 75.

Then, the right and left side walls of the panel frame 90 contact the lower end parts of the four snap-fits 78, and the four snap-fits 78 elastically deform outward in the right-and-left direction.

As the panel unit 64 is further rotated counterclockwise when viewed from the left, the contacting state of the right and left side walls of the stepped parts 96 and the lower end parts of the four snap-fits 78 is released. Then, the four snap-fits 78 elastically re-form and engages with the right and left side walls of the stepped parts 96.

Thus, the panel unit 64 is attached to the top cover 63.

At this stage, the panel plate 95 is inserted in the panel exposing opening 75 as shown in FIG. 2. The inner periphery of the panel exposing opening 75 and the outer periphery of the panel plate 95 are next to each other with defining a clearance C2 therebetween. The clearance C2 has a substantially ring-shaped plan view.

The upper surface of the panel plate 95 and the upper surface of the surrounding part 66 of the top cover 63 are substantially on the same plane as shown in FIG. 11B. The curved portion of the stepped parts 96 is below and adjacent to the panel exposing opening 75 at the surrounding part 66.

Next, the panel cover 74 is attached to the top cover 63 such that the panel unit 64 attached to the top cover 63 is covered by the panel cover 74 from below as shown in FIGS. 6A and 6B. In order to attach the panel cover 74 to the top cover 63, the panel cover 74 is firstly arranged to incline such that the rear end part of the panel cover 74 is located at a position higher than the front end portion thereof, and the fitting protrusion 129 is inserted in the fitting hole 81 of the engaging plate 80 from the lower front position.

Figure 7:
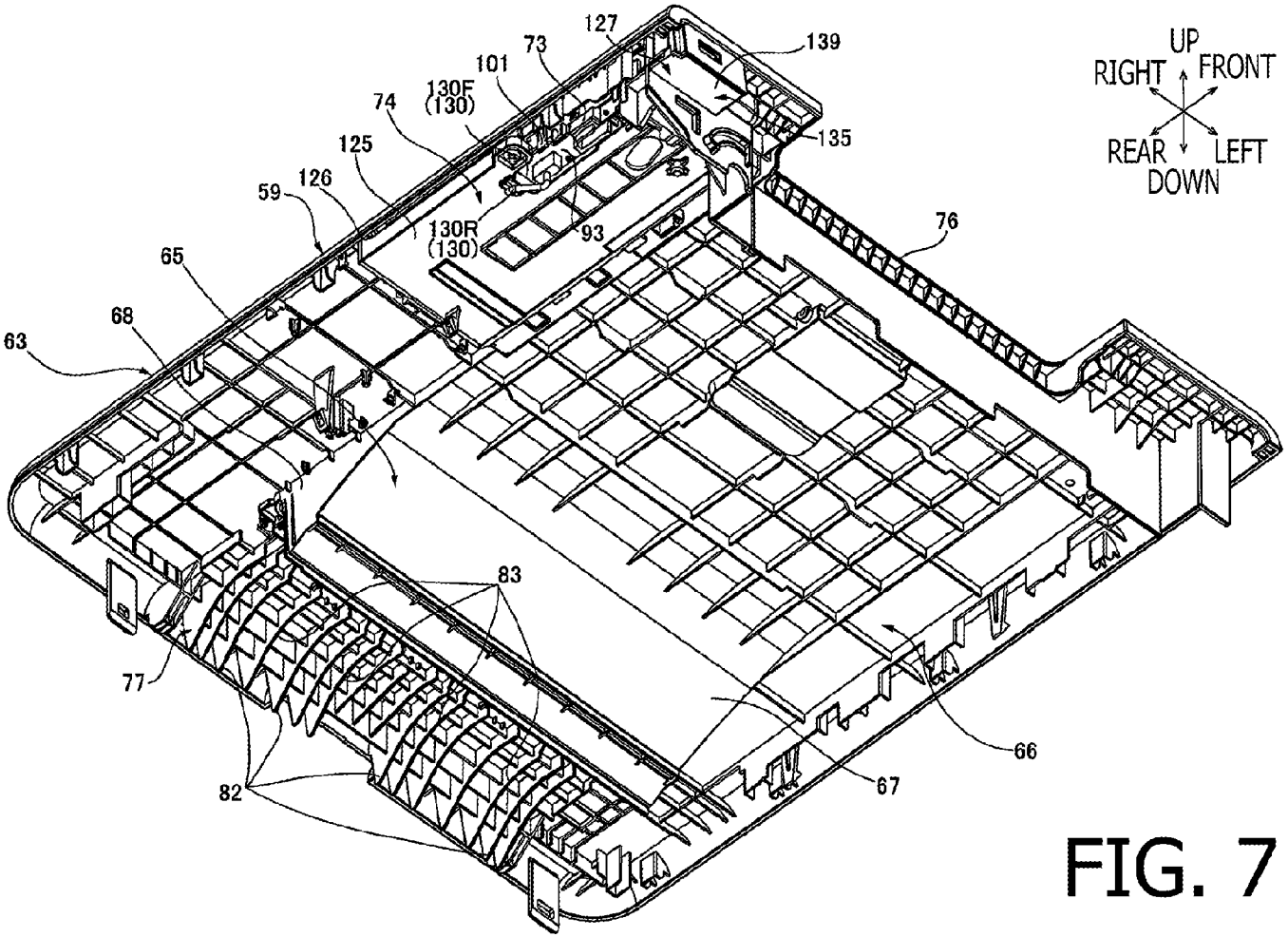
FIG. 7 is a perspective view of the upper wall shown in FIG. 3, viewed from a lower right side thereof.

Then, the panel cover 74 is rotated counterclockwise when viewed from the left side as the fitting protrusion 129 as a fulcrum. Thereafter, as shown in FIG. 7, the panel cover 74 is secured by screws on the lower surface of the surrounding part 66 of the top cover 63. Thus, the panel unit 64 is accommodated inside the panel cover 74.

At this stage, the plurality of spacers 132 contact the panel substrate 93 from below as shown in FIGS. 11B and 12B, and the panel substrate 93 and the cover plate 125 face each other with a space therebetween in the up-and-down direction.

The right end portion of the right peripheral wall 126C is located on the right side with respect to the right part of the clearance C2 as shown in FIG. 11B. Although not shown in FIG. 11B, the rear peripheral wall 126B is located on the rear side with respect to the rear part of the clearance C2, and the left peripheral wall 126A is located on the left side with respect to the left part of the clearance C2.

The regulation wall 128 is arranged between the panel substrate 93 of the panel unit 64 and the USB substrate arrangement part 135 of the substrate arrangement part 127, in the front-and-rear direction, as shown in FIGS. 12A and 12C. the first regulation part 128A of the regulation wall 128 is located on the front side with respect to the front part of the clearance C2.

The substrate arrangement part 127 is arranged on the left side with respect to the panel unit 64 with a space therebetween. That is, the substrate arrangement part 127 is arranged at a position which does not overlap the panel unit 64 when viewed from the up-and-down direction. The USB substrate arrangement part 135 of the substrate arrangement part 127 is configured to receive the USB substrate 72 such that the bottom plate part 139 covers the USB substrate 72 from below, as shown in FIG. 7.

As above, the attachment of the panel unit 64 and the panel cover 74 to the top cover 63 is performed.

The front extending part 113F is arranged above the front liquid vent 130F with a space therebetween such that the front extending part 113F overlaps, in the up-and-down direction, the central part, in the front-and-rear direction, of the front liquid vent 130F, and the vent 118 on the front side overlaps the front liquid vent 130F when viewed in the up-and-down direction. Further, the rear extending part 113R is arranged above the rear liquid vent 130R with a space therebetween such that the rear extending part 113R overlaps the rear liquid vent 130R when viewed in the up-and-down direction, and the vent 118 on the rear side overlaps the rear liquid vent 130R when viewed in the up-and-down direction.

The left wall 61 is a left end portion of the casing 2 as shown in FIG. 2, and is arranged on the left side with respect to the image forming unit 4 as shown in FIG. 11B.

Figure 3:
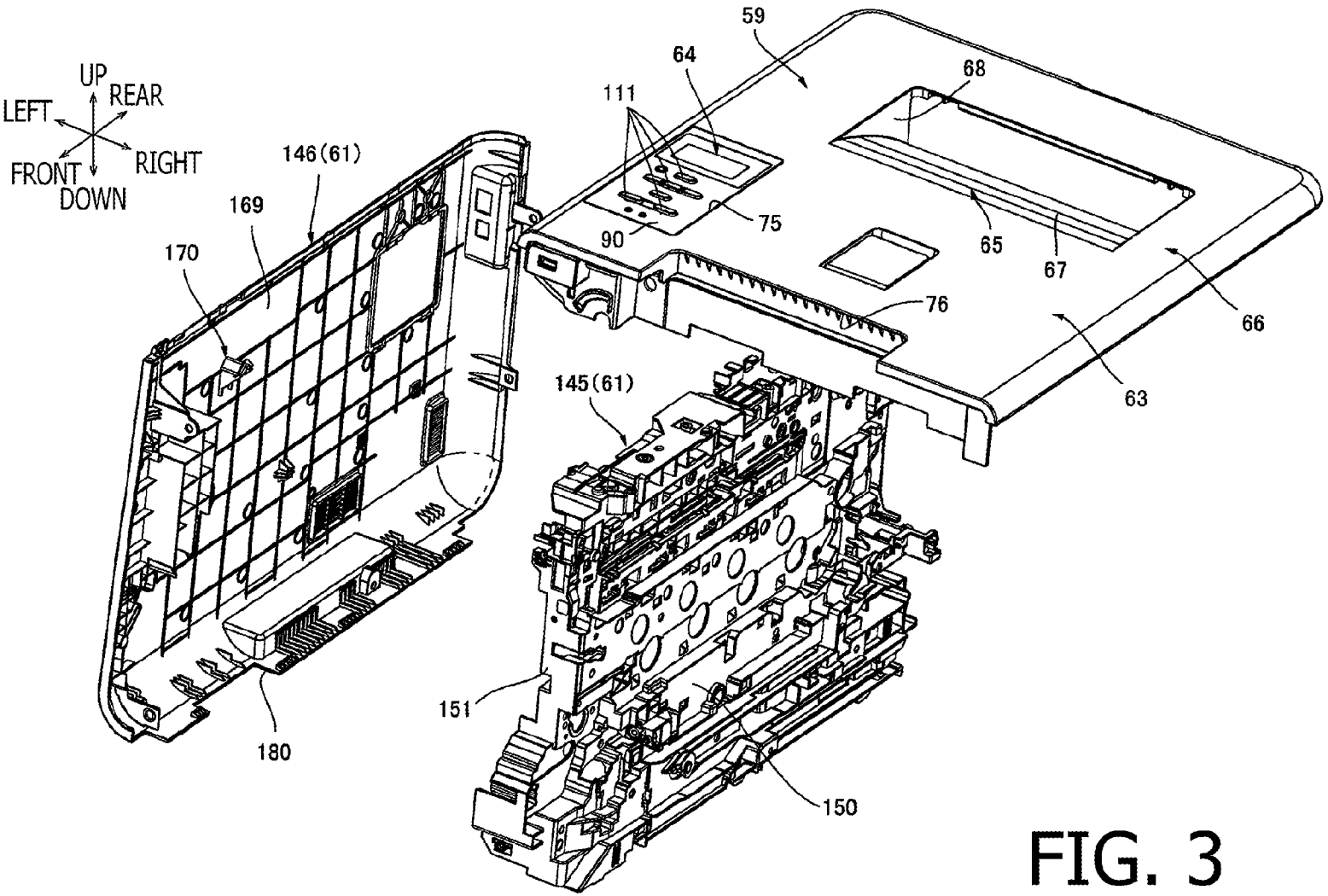
FIG. 3 shows an exploded perspective view of an upper wall and a left wall and of the printer, viewed from a right front side thereof.

The left wall 61 has a substantially rectangular side view extending in the front-and-rear direction as shown in FIG. 2, and has a frame 145 and a side cover 146 as shown in FIG. 3.

The frame 145 is a right portion of the left wall 61, and is arranged on the left side with respect to the image forming unit 4 and below the panel cover 74, as shown in FIG. 11B.

The frame 145 is made of well-known resin material, and has a body plate 150 and a frame periphery wall 151 as shown in FIG. 3.

The body plate 150 is a plate-like member having a substantially rectangular side view extending in the front-and-rear direction. A vertical part 159 thereof extends in the up-and-down direction and in the front-and-rear direction. The body plate 150 is arranged on the left side with respect to the image forming unit 4 as shown in FIG. 11B. The frame peripheral wall 151 protrudes leftward from the entire periphery of the body plate 150. The frame 145 has U-shaped cross section opening toward the left side when taken along the up-and-down direction and the front-and-rear direction. Further, the left end part of the upper wall of the frame peripheral wall 151 is arranged on the right side with respect to the liquid vent 130 as shown in FIG. 11B.

Figure 9A:
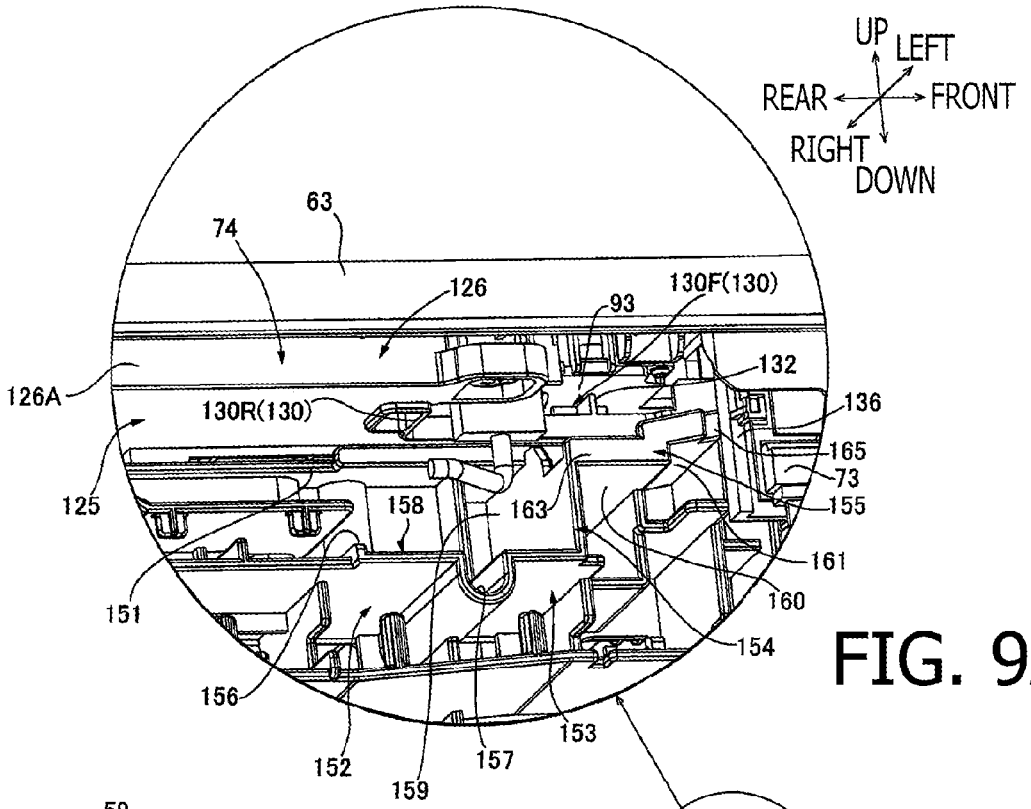
FIG. 9A is an enlarged view of a portion circled in FIG. 9B
Figure 9B:
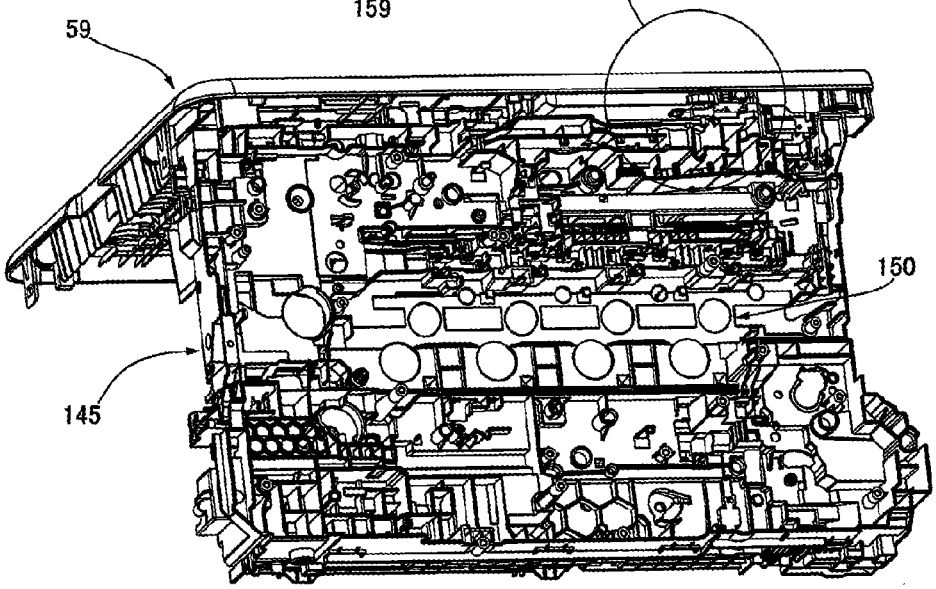
FIG. 9B is a perspective view of the upper wall shown in FIG. 3, viewed from a lower left side thereof.

The frame 145 has a liquid guide part 152 as shown in FIGS. 9A and 9B. The liquid guide part 152 is arranged on the upper front part of the left surface of the body plate 150, and below the front portion of the panel cover 74 as shown in FIG. 11B.

The liquid guide part 152 includes, as shown in FIGS. 9A and 9B, a first wall 153, a second wall 155 and a third wall 156.

The first wall 153 has a plate-like part having a crank-shaped side view, and protrudes leftward from the left surface of the body plate 150. The first wall 153 has a first portion 158 which is a rear portion of the first wall and a second portion 154 which is a front portion of the first wall 153.

The first part 158 has a plate-like part having a substantially rectangular plan view and extends in the front-and-rear direction as shown in FIG. 12B. the first part 158 is arranged below the rear liquid vent 130R with a space therebetween such that the first part 158 overlaps the rear extending part 113R and the rear liquid vent 130R when viewed from the up-and-down direction.

The first part 158 has a drain groove 157. The drain groove 157 is arranged below the front liquid vent 130F with a space therebetween such that the drain groove 157 overlaps the rear end part of the front liquid vent 130F and slightly shifted frontward with respect to the rear liquid vent 130R when viewed from the up-and-down direction. The drain groove 157 has a semicircle or U-shaped cross section opened to the upside, recessed downward with respect to the upper surface of the first part 158 of the first wall 153. The drain groove 157 extends in the right-and-left direction over the entire length of the first wall 153 in the right-and-left direction. Thus, the drain groove 157 is opened leftward directed to the side cover 146.

The second part 154 is arranged on the front side with respect to the first part 158 as shown in FIG. 12B. the second part 154 is a plate-like part having a substantially L-shaped side view, and extends in the front-and-rear direction. Specifically, the second part 154 integrally includes a vertical part 159, a horizontal part 160 and an inclined part 151. The vertical part 159 is connected to the front end portion of the first part 158 and extends upward therefrom. The horizontal part 160 is connected to the upper end portion of the vertical part 159 and extends frontward therefrom. The inclined part 161 is connected to the front end portion of the horizontal part 160 and is inclined to be higher as it goes frontward.

The second wall 155 is plate-like shape having a substantially crank-like side view as shown in FIGS. 9A and 9B. The second wall 155 protrudes upward from the left end portions of the horizontal part 160 and the inclined part 161, and is arranged on the left side with respect to the second regulation part 128B of the regulation wall 128 as shown in FIG. 8.

The second wall 155 extends in the front-and-rear direction and integrally includes a rear part 163 and a front part 165.

The rear part 163 is a part protruding upward from the left end part of the horizontal part 160, having a substantially rectangular side view extending in the front-and-rear direction, and extends, in the plan view, substantially straight as shown in FIGS. 12A and 12C. the front part 165 is a part protruding upward from the left end part of the horizontal part 160 having a substantially rectangular side view, and extends, in the side view, in the front-and-rear direction as shown in FIGS. 9A and 9B. Further, the front part 165 has a substantially crank-like shape in the plan view.

Specifically, the front part 165 is connected to the upper front portion of the rear part 163, extends frontward therefrom, bent rightward and then bent frontward.

With the above configuration, the front end part of the front part 165 of the second wall 155 is arrange on the right side and next to the rear end part of the communication substrate supporting part 136 such that the front end part 165 of the second wall 155 overlaps the rear end portion of the communication substrate supporting part 136 when viewed in the right-and-left direction. Further, the front end portion of the front part 165 is arranged on the front side with respect to the rear end part of the second regulation part 128B of the regulation wall 128.

The third wall 156 is arranged on the upper surface of the first wall 153, at a position on the rear side of the drain groove 157, that is, on an opposite side to the second part 154 with respect to the drain groove 157, with a space therebetween as shown in FIG. 12B. The third wall 156 is located on the rear side with respect to the rear liquid vent 130R. The third wall 156 has a substantially rectangular side view and protrudes upward from the upper surface of the first wall 153. Further, the third wall 156 extends in the right-and-left direction over the entire length of the firs wall 153 in the right-and-left direction as shown in FIGS. 9A and 9B.

The side cover 146 is a left portion of the left wall 61 as shown in FIG. 11B, and arranged next to the frame 145 on the left side thereof. The side cover 146 covers the frame 145 from the left side thereof as shown in FIG. 2. The side cover 146 is made of a well-known resin material and is formed to be a plate-like member having substantially the same shape and size as the frame 145 in the side view thereof.

Figures 10A, 10B:
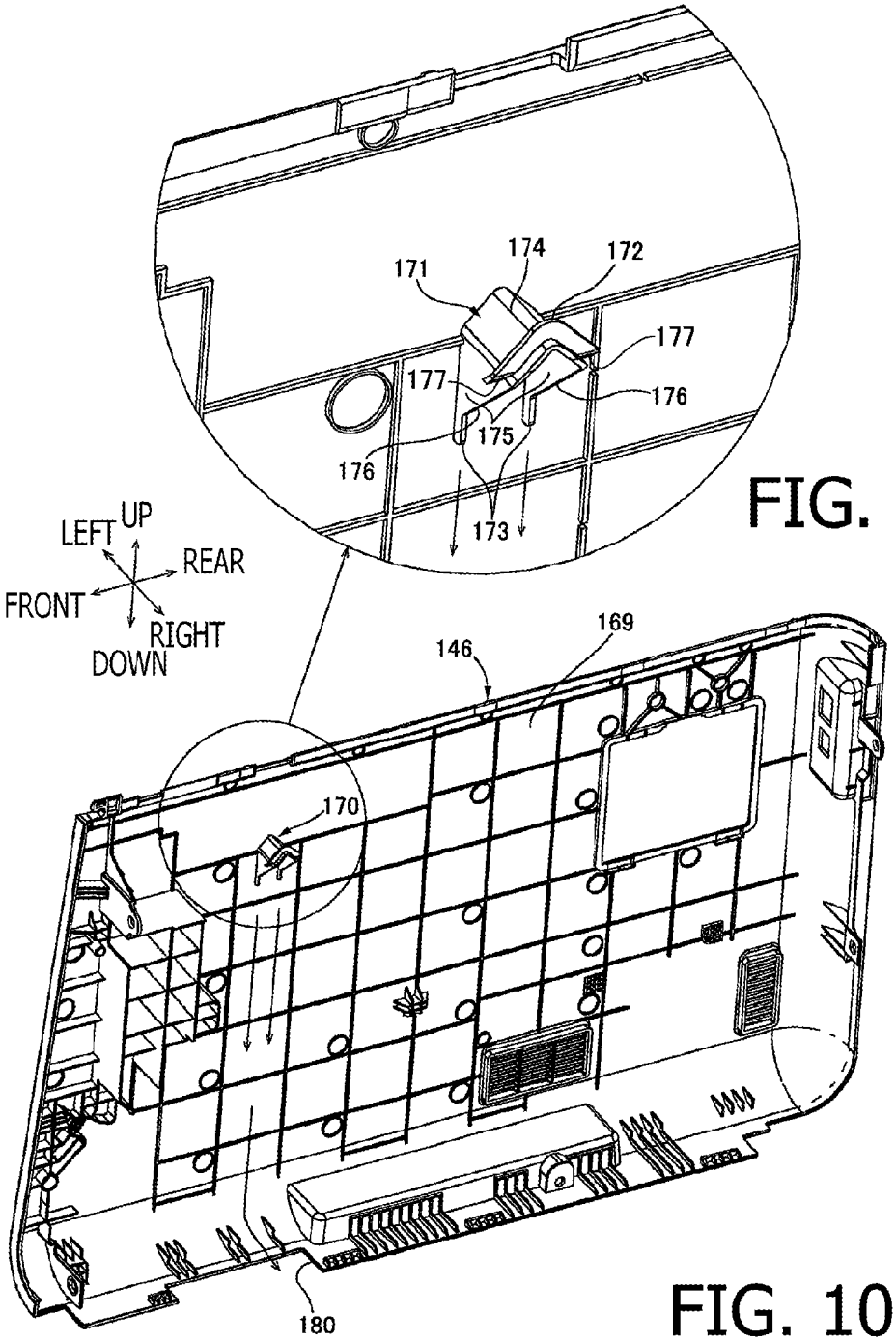
FIG. 10A is an enlarged view of a portion circled in FIG. 10B
FIG. 10B is a perspective view of a side cover shown in FIG. 3, viewed from a right front side thereof.

Further, the side cover 146 has a side cover body 169 and a reception part 170 as shown in FIGS. 10A and 10B.

The side cover body 169 is a plate-like part having a substantially rectangular side view extending in the front-and-rear direction. The lower end part of the side cover body 169 is curved to right as it is directed to the lower direction such that the lower end part of the side cover body 169 covers the lower end part of the frame 145.

The side cover body 169 has a cutout groove 180 which is arranged on the front part of the lower end portion of the side cover body 169. The cutout groove 180 has a U-shaped plan view opened toward the right side, and recessed leftward from the lower end of the side of the side cover body 169.

The reception part 170 is arranged on the right surface of the side cover body 169 at an upper front position thereof, and is above the cutout groove 180. The reception part 170 is arranged on the left side and below with respect to the liquid guide unit 152 as shown in FIG. 11B. The reception part 170 protrudes rightward from the right surface of the side cover body 169 as shown in FIGS. 10A and 10B, and integrally includes a body part 171, a protruded part 172 and a pair of extended parts 173.

The body part 171 has a U-shaped side view which is opened toward the down side, and protrudes rightward from the right surface of the side cover body 169. The right end part of the body part 171 overlaps the left end part of the cutout groove 157 when viewed in the up-and-down direction.

The body part 171 has a wedge part 174 and a pair of plate parts 175.

The wedge part 174 is defined as an upper part of the body part 171 and has a wedge-shaped side view having an apex directed upward. The pair of plate parts 175 are lower parts of the body part 171 and face each other with a space therebetween.

Each of the plate parts 175 is a plate-like part having a substantially triangular front view having an apex directed downward, and extends downward from each of the front and rear ends of the wedge part 174. The left end parts of the pair of plate parts 175 are connected to the right surface of the side cover body 169.

Each of the pair of plate parts 175 has an inclined end 176. The inclined end 176 is a lower end of the plate part 175 and extends in a direction connecting a lower left position and an upper right position. That is, each inclined end 176 inclines, from the right end part thereof, more downward as it goes leftward to approach the side cover body 169.

The protruded part 172 is a plate-like part having a wedge-shape side view having an apex directed upward, and protrudes upward from the right end part on the upper surface of the wedge part 174. The protruded part 172 is arranged on the right side with respect to the left end part of the drain groove 157 as shown in FIG. 11B.

The protruded part 172 has inclined parts 177 as shown in FIGS. 10A and 10B. The inclined parts 177 are front and rear ends of the protruded part 172 and extend in the direction connecting the lower left position and the upper right position so that the inclined parts 177 are substantially parallel with the inclined ends 176. That is, each of the inclined parts 177 inclines more downward as it goes leftward so as to approach the side cover body 169.

The pair of extending parts 173 are lower ends of the reception part 170, respectively connected to the left side ends of the pair of plates 175, and extend downward therefrom. Thus, the pair of extending parts 173 face with each other in the front-and-rear direction with a space therebetween. Specifically, the extending parts 173 each has a rod-like shape extending in the up-and-down direction, connected to the left end parts of the inclined ends 176 and extend downward, along the right surface of the side cover body 169.

A right wall 60 is a right side part of the casing 2 as shown in FIG. 1, and arranged on the right side with respect to the image forming unit 4 such that the image forming unit 4 is sandwiched by the right wall 60 and the left wall 61. The right wall 60 has a substantially rectangular side view extending in the front-and-rear direction.

A rear wall 62 is a rear side part of the casing 2 and is arranged on the rear side with respect to the image forming unit 4. The rear wall 62 is connected with the rear end portion of the right wall 60 and the rear end portion of the left wall 61 along the right-and-left direction.

A front cover 10 is arranged between the front end portion of the right wall 60 and the front end portion of the left wall 61 as shown in FIG. 2. In the description concerning the front cover 10 hereinafter, directions are indicated based on those when the front cover 10 is located at a closed position which is indicated by solid line in FIG. 2.

The front cover 10 has a front cover body 185 and a grip member 186.

The front cover body 185 has a planar plate-like member having a substantially rectangular front view extending in the right-and-left direction. The front cover body 185 is rotatably supported by the right wall 60 and left wall 61 such that the front cover body 185 is rotatable with the lower end part there of being a fulcrum (i.e., an axis of rotational movement).

The grip member 186 is arranged at an upper portion of the front cover body 185 and supported thereby at a substantially central portion in the right-and-left direction on the upper portion of the front cover body 185.

The grip member 186 has a plate-like shape having a substantially rectangular plan view extending in the right-and-left direction. The grip member 186 is received within a recessed part 76 of the top cover 63 when the front cover 10 is located at the closed position, which is the position of the front cover 10 indicated by the solid line in FIG. 1. At this stage, the upper surface of the grip member 186 is substantially on the same plane of the upper surface of the surrounding part 66, and the discharge tray 11, the surrounding part 66, the panel plate 95 of the panel unit 64 and the grip portion 186 substantially constitute the upper surface of the casing 2.

Although a detailed description will not be provided since it is a well-known structure, the grip member 186 is configured to be movable in the up-and-down direction. When the front cover 10 is located at the closed position, the grip member 186 engages with the surrounding part 66 and locks the front cover 10 at the closed position. When the user depressed the grip member 186 from above, the grip member 186 is displaced downward, thereby the engagement between the grip member 186 and the surrounding part 66 is released. Then, the lock of the front cover 10 is released and a rotational movement of the front cover 10 is allowed.

3. Guiding of Liquid

If a user inadvertently spills liquid such as water on the printer 1 from above the casing 2, the spilt liquid may be soused on the upper wall 59 of the casing 2.

The soused liquid may enter the clearances C1 formed between the plurality of buttons 111 and the button holes 97, respectively. The liquid entered the clearances C1 flows between the outer periphery of the button bodies 115 and corresponding inner surfaces of the button collars 100, and reaches on the planar part 110 of the rubber key 91 as shown in FIG. 11B.

As a result, the liquid is received by the planar part of the rubber key 91 and the peripheral wall 112. Then, the liquid flows along the upper surface of the planar part 110 as shown in FIGS. 8 and 13. Thereafter, the liquid received by the rubber key 91 passes through the two vents 118, flows along the extending bottom parts 117 and discharged from the extending parts 113.

Specifically, as shown in FIG. 12B, the liquid discharged from the front side vent 118 passes through the front extending part 113F and falls downward and passes through the front liquid vent 130F. Then, the liquid falls down on the upper surface of the horizontal part 160 of the liquid guide part 152. Thereafter, the liquid flows along the horizontal part 160 and then the vertical part 159 and flows rearward. After the liquid reaches the upper surface of the first wall 153, the liquid enters the drain groove 157.

The liquid discharged from the rear side vent 118 passes through the rear extending part 113R, falls downward and passes through the rear liquid vent 130R. Then, the liquid falls on the rear part of the drain groove 157 on the upper surface of the first wall 153. Thus, the drain groove 157 is configured to receive the liquid entered the casing 2.

The drain groove 157 guides leftward the liquid entered the drain groove 157 toward the side cover 146 as shown in FIG. 11B. Then, the liquid is discharged from the left end part of the drain groove 157 and falls down to the receiving part 170.

The protruded part 172 of the receiving part 170 receives the liquid dropping down from the drain groove 157 so as to proceed along the inner surface thereof, and guides the liquid toward the body part 171. Thus, the liquid is transferred from the liquid guide part 152 to the receiving part 170. Then, the liquid proceeds along the inclined end 176 of the body part 171, and flows toward the right surface of the side cover body 169.

Then, the liquid is transferred from the inclined end 176 to the extending part 173, and flows down along the extending part 173. Thereafter, the liquid flows downward along the right surface of the side cover body 169, and discharged to outside of the casing 2 through the cutout groove 180.

Further, when the liquid is soused on the upper surface of the upper wall 59, the liquid may enter the clearance C2 defined between the panel plate 95 of the panel frame 90 and the panel exposing opening 75 as shown in FIG. 2.

The liquid entered the clearance C2 proceeds along the outer surface of the stepped parts 96 and flows in a direction away from the panel plate 95 as shown in FIG. 11B. That is, the stepped parts 96 guide the liquid so as to move away from the panel substrate 93. Thereafter, the liquid guided by the stepped parts 96 falls from the lower end of the stepped parts 96 onto the upper surface of the panel cover 74. Specifically, part of the liquid entered through the right part of the clearance C2 is received by the upper surface of the right peripheral wall 126C, flows along the cover peripheral wall 126 and reaches the upper surface of the cover plate 125.

The liquid reached the upper surface of the cover plate 125 flows between, in the up-and-down direction, the cover plate 15 and the panel substrate 93 along the upper surface of the cover plate 125, and discharged toward the liquid guide part 152 through the two liquid vents 130.

At this stage, as shown in FIG. 12B, the liquid discharged from the front part of the front liquid vent 130F falls on the upper surface of the inclined part 161 of the liquid guide part 152. Then, the inclined part 161 guides the liquid rearward so as to be directed to the drain groove 157 with its inclination.

Thereafter, the liquid proceeds along the horizontal part 160, the vertical part 159 and the first wall 153 and reaches the drain groove 157.

The liquid discharged from the rear part of the front liquid vent 130F falls on the horizontal part 160 or upper surface of the first wall 153, at a position in front of the drain groove 157, and then flows in the drain groove 157.

The liquid discharged from the rear liquid vent 130R falls on the rear side portion with respect to the drain groove 157 on the upper surface of the first wall 153, and then flows into the drain groove 157.

The liquid entered the drain groove 157 is, as shown in FIG. 11B, transferred to the receiving part 170, flows along the right surface of the side cover body 169, and then discharged from the casing 2 to outside through the cutout groove 180 as shown in FIGS. 10A and 10B.

Since the panel unit 64 is arranged to be inserted in the panel exposing opening 75 of the top cover 63 as shown in FIG. 2, when the positions or number of the rubber key 91 and/or the display unit 92, the design of only the panel unit 64 is changed first, and then the changed panel unit 64 may be inserted to the panel exposing opening 75 of the top cover 63 without changing the design of the panel exposing opening 75 as shown in FIGS. 6A and 6B.

Therefore, even if the design of the panel unit 64 is changed, it is not necessary to change the top cover 63, an increase of a manufacturing cost to change the design of the panel unit 64 can be suppressed.

The grip member 186 of the front cover 10 located at the closed position is received by the recessed part 76 of the top cover 63, even if the printer 1 is provided with the front cover 10, upsizing of the printer 1 can be suppressed. Further, since the grip member 186 of the front cover 10 at the closed position serves a part of the upper surface of the casing 2, the user can access the grip member 186 easily.

As shown in FIG. 5, the top cover 63 has the sheet conveying guide 77 for guiding the sheet P conveyed toward the sheet discharge tray 11. Further, the ribs 82 of the conveying guide 77 guide the sheet P directed to the sheet discharge tray 11, it is ensured that the sheet P is discharged from the casing 2 to the sheet discharge tray 11.

Since the top cover 63 has the conveying guide 77, the number of components can be decreased in comparison with a case where the top cover 63 and the conveying guide 77 are made separately.

The cover engaging part 79 and the panel engaging part 103 can engage with each other with panel unit 64 is inserted in the panel exposing opening 75 as shown in FIG. 4. Therefore, even in if the panel unit 64 and the top cover 63 are separate members, it is possible to maintain the relative positions thereof constant.

Since the rubber key 91, display unit 92 and the panel substrate 93 can be attached to the panel frame 90 as shown in FIGS. 6A and 6B, it is possible to maintain the relative positions of the rubber key 91, the display unit 92 and the panel substrate 93. Therefore, the electrical connection among the rubber key 91, the display unit 92 and the panel substrate 93 are ensured.

Since the panel cover 74 covers the panel unit 64 from below, the panel unit 64 can be well protected.

Since the panel cover 75 supports the communication substrate 74 as shown in FIG. 4, the function of the panel unit 64 can be improved.

As shown in FIG. 11B, the frame 145 has the drain groove 157. Therefore, when the liquid is soused on the upper wall 59 of the casing 2, and enters inside the casing 2 through the clearance C2 formed between the top cover 63 and the panel unit 64, the liquid is received by the drain groove 157. Since the drain groove 157 is opened leftward, directed to the side cover 146, the liquid received by the drain groove 157 is discharged on the left side with respect to the drain groove 157, that is the side away from the image forming unit 4. Then, the liquid discharged from the drain groove 157 is received by the receiving part 170 which is arranged to overlap the drain groove 157 when viewed from the up-and-down direction.

That is, the liquid enters the casing 2 through the clearance C2 defined between the top cover 63 and the panel unit 64 is received by the drain groove 157 of the frame 145, flows in a direction away from the image forming unit 4, and is transferred to the side cover 146 which is arranged on the opposite side to the image forming unit 4 with respect to the frame 145.

With the above configuration, even if the liquid enters the casing through the clearance C2 formed between the top cover 63 and the panel unit 64, it is ensured that components such as the image forming unit 4 are prevented from being soused by the liquid.

Since the receiving part 170 has the protruded part 172 that protrudes upward from the right end part of the body part 171 as shown in FIG. 11B, the liquid discharged from the drain groove 157 proceeds along the protruded part 172 and transferred to the body part 171. Therefore, the receiving part 170 stably receives the liquid discharged from the drain groove 157.

Since the plate-like part 175 of the body part 171 has the inclined ends 176 as shown in FIG. 11B, the liquid received by the receiving part 170 flows along the inclined part 176 toward the side cover 146. Therefore, it is ensured that the liquid received by the receiving part 170 is guided toward the side cover 146.

Since the protruded part 172 has the inclined part 177 as shown in FIGS. 10A and 10B, the liquid flowing along the protruded part 172 proceeds toward the side cover 146 along the inclined part 177. Therefore, it is ensured that the liquid proceeding along the protruded part 172 is guided toward the side cover 146.

Since the extending part 173 is connected to the inclined part 176 and extends downward therefrom toward the side cover 146 as shown in FIGS. 10A and 10B, the liquid received by the receiving part 170 flows along the inclined part 176 and flows downward by the extending part 173, along the side cover 146. That is, the liquid received by the receiving part 170 can be well guided by the above configuration.

Since the second wall 155 protrudes upward from the left end part of the first wall 153 as shown in FIG. 8, when the liquid entering through the clearance C2 falls onto the first wall 153, the second wall 155 prevents the liquid from dropping leftward from the first wall 153. Therefore, it is ensured that the liquid entering the casing 2 through the clearance C2 can be received by the drain groove 157 provided to the first wall 153.

When the liquid entering the casing 2 through the clearance C2 falls on the inclined part 161 of the second portion 154 of the first wall 153, the inclined part 161 guides the liquid toward the first part 158 which is provided with the drain groove 157. Further, since the second wall 155 protrudes upward from the left end part of the inclined part 161 as shown in FIG. 8, it is ensured that the liquid falls on the second wall 155 is guided toward the drain groove 157.

Since the third wall 156 protruding upward from the first wall 153 is arranged on the opposite side, in the front-and-rear direction, to the vertical part 159 of the second part 154 with respect to the drain groove 157, on both sides, in the front-and-rear direction, of the drain groove 157, the third wall 1156 and the vertical part 159 are arranged, respectively. Therefore, it is possible to suppress the liquid from flowing away from the drain groove 157, and it is ensured that the liquid is directed to the drain groove 157.

Since the panel cover 74 is attached to the surrounding part 66 so as to cover the panel unit 64 from below, as shown in FIG. 7, the liquid entered through the clearance is initially received by the panel cover 74 as shown in FIG. 11B.

Since the panel cover 74 has the liquid vent 130 at a position that overlaps the drain groove 157 when viewed from the up-and-down direction, the liquid received by the panel cover 73 falls on the drain groove 157 through the liquid vent 130.

Accordingly, the liquid entered the casing 2 through the clearance C2 can surely be directed to the drain groove 157.

Since the panel frame 90 has the stepped part 96 as shown in FIG. 11B, the liquid entered through the clearance C2 is caused to proceed away from the panel plate 95 by the stepped part 96. Accordingly, it is possible to prevent the panel substrate 94 attached to the panel frame 90 from being soused by the liquid entered through the clearance C2.

Since the regulation wall 129 is arranged between the panel substrate 93 and the substrate arrangement part 127 as shown in FIG. 8, the liquid received by the panel cover 74 is prevented from moving toward the substrate arrangement part 127. As a result, the USB substrate 72 and the communication substrate 73 arranged on the substrate arrangement part 127 can be prevented from being soused by the liquid.

Since the substrate arrangement part 127 is arranged at a position which does not overlap the panel unit 64 when viewed in the up-and-down direction as shown in FIG. 8, it is possible to prevent the USB substrate 72 and the communication substrate 73 from soused by the liquid entered the casing 2 through the clearance C2.

Since the second regulation part 128B of the regulation wall 128 is arranged close to the front liquid vent 130F when viewed from the up-and-down direction as shown in FIG. 8, the liquid of which movement is restricted by the regulation wall 128 flows along the first regulation part 128A and the second regulation part 128B, and then discharged toward the drain groove 157 from the panel cover 74, through the front liquid vent 130F. Therefore, it is possible to guide the liquid received by the panel cover 74 toward the drain groove 175 with preventing the USB substrate 72 and the communication substrate 73 from being soused by the liquid.

Since the second regulation part 128B of the regulation wall 128 is arranged on the right side with respect to the second wall 155 as shown in FIG. 8, the liquid of which movement is restricted by the regulation wall 128 flows along the second regulation part 128B of the regulation wall 128, and then falls on the second part 154 through the front liquid vent 130F. Therefore, it is possible to guide the liquid received by the panel cover 74 toward the second part 154 with preventing the USB substrate 72 and the communication substrate 73 from being soused by the liquid.

Since the front end part of the second wall 155 is arranged on the front side with respect to the rear end part of the second regulation part 128B as shown in FIGS. 12A and 12C, it is possible to prevent the liquid of which movement is restricted by the restriction wall 128 from falling on the left side with respect to the second wall 155 when the liquid falls on the second part 154. Therefore, it is possible to cause the liquid of which movement is restricted by the restriction wall 128 to fall on the second part 154 of the first wall 153.

Since the front end part of the second wall 155 is arranged on the right side of and next to the communication substrate supporting part 136 so as to overlap the rear end of the communication substrate supporting part 136 of the substrate arrangement part 127 when viewed from the right-and-left direction as shown in FIGS. 12A and 12C, it is possible to prevent the communication substrate 73 arranged on the communication substrate supporting part 136 from being soused by the liquid on the second part 154 with the front end part of the second wall 155.

Since the rubber key 91 has the planar part 110 and the peripheral wall 112 as shown in FIG. 11A, the liquid entered through the clearances C1 formed between the plurality of buttons 111 and the panel frame 90 is received by the planar part 110 and the peripheral wall 112. Therefore, it is possible to prevent the panel substrate 93, which is arranged below and next to the planar part 110, from being soused by the liquid entered through the clearances C1.

Since the peripheral wall 112 has the vents 118 that overlap the liquid vent 130 when viewed in the vertical direction as shown in FIG. 12B, it is ensured that the liquid received by the rubber key 91 falls toward the drain groove 157 through the vents 118 and the liquid vent 130. Therefore, it is ensured that the liquid entered the casing 2 through the clearances C1 is guided toward the drain groove 157.

Since the extending side part 119 is arranged on the left side with respect to the extending bottom part 117 as shown in FIG. 13, the extending side part 119 prevents the liquid falls down from the extending bottom part 117 from being sprinkled in the front and rear directions with respect to the extending side part 119. Therefore, the liquid can be guided on the left side or down side with respect to the extending bottom part 117.

Since the lower part of the extending bottom part 117 spaced from the panel substrate 93 on the left side and the lower surface of the panel substrate 93 are located on substantially the same plane, it is ensured to prevent the pane substrate 93 from being soused by the liquid falling down from the extending bottom part 117.

What is claimed is:

1. An image forming apparatus, comprising:

a casing;

a panel unit provided with at least one of an operation unit acquiring an operation to control the image forming apparatus and a display unit;

a discharge tray configured to receive a recording medium discharged from the casing, wherein the casing comprises a first cover arranged above an image forming unit and constituted at least a part of an upper surface of the casing, wherein the first cover includes:

a tray part which is at least a part of the discharge tray; and a surrounding part configured to surround the tray part, wherein the panel unit is inserted in the surrounding part, wherein the casing includes a side wall arranged on one side in a first direction that is orthogonal to a vertical direction with respect to the image forming unit, the side wall being provided with a frame and a second cover arranged next to and on the one side of the first direction of the frame, wherein the frame has a first drain groove being opened toward the one side of the first direction, toward the second cover, wherein the second cover has a receiving part protruding toward the other side in the first direction from the second cover, and wherein the receiving part is arranged on a lower side with respect to the first drain groove and overlaps the first drain groove in the vertical direction.

2. The image forming apparatus according to claim 1, wherein the receiving part includes:

a body part protruding toward the other side in the first direction from the second cover; and a protruding part protruding upward from the other end, in the first direction, of the body part.

3. The image forming apparatus according to claim 2, wherein the body part has an inclined portion which inclines downward, from the other end in the first direction of the body part toward the one side in the first direction so as to approach the second cover.

4. The image forming apparatus according to claim 3, wherein the protruding part has an inclined part which inclines downward toward the second cover such that the inclined part is substantially parallel with the inclined portion.

5. The image forming apparatus according to claim 3, wherein the receiving part includes an extending part which is connected to the inclined portion and extends downward along the second cover.

6. The image forming apparatus according to claim 1, wherein the frame includes:

a plate extending in a vertical direction and in a second direction which is orthogonal to the vertical direction and the first direction;

a first wall protruding on the one side in the first direction from the plate and extending in the second direction, the first wall being provided with the first drain groove; and a second wall protruding upward from one end, in the first direction, of the first wall.

7. The image forming apparatus according to claim 6, wherein the first wall includes:

a first part having the first drain groove; and a second part connected to the first part, and wherein the second wall protrudes upward from the one end in the first direction of the second part.

8. The image forming apparatus according to claim 7, wherein the frame includes a third wall which is arrange on an opposite side to the second part, in the second direction with respect to the first drain groove, the third wall protruding upward from the first wall and extending in the first direction.

9. The image forming apparatus according to claim 6, further includes a panel cover arranged below the panel unit and above the first drain groove and configured to be attached to the first cover so as to cover the panel unit from below, the panel cover having a second drain groove overlapping the first drain groove in the vertical direction.

10. The image forming apparatus according to claim 8, wherein the panel unit comprises:

a substrate configured to be electrically connected to the at least one of the operation unit and the display unit;

a panel frame which is configured such that the substrate and the at least one of the operation unit and the display unit are attached to the panel frame; and a panel cover which is arranged below the panel unit and configured to be attached to the first cover so as to cover the panel unit from below, and wherein the panel cover has a substrate arrangement part at which a second substrate which is different from the substrate is arranged.

11. The image forming apparatus according to claim 10, wherein the surrounding part has an opening extending between an interior of the surrounding part and an exterior of the surrounding part; and wherein the panel frame comprises:

a panel plate arranged at a position of the opening; and a stepped part which extends downward from a periphery of the panel plate.

12. The image forming apparatus according to claim 10, wherein the panel cover has a wall part extending in the vertical direction and arranged between the substrate and the substrate arrangement part.

13. The image forming apparatus according to claim 12, wherein the substrate arrangement part is arranged at a position that does not overlap the panel unit in the vertical direction, and wherein the wall part is arranged between the panel unit and the substrate arrangement part.

14. The image forming apparatus according to claim 12, wherein the wall part extends in the first direction, and wherein the one end, in the first direction, of the wall part is located adjacent to the opening.

15. The image forming apparatus according to claim 12, wherein the one end, in the first direction, of the wall part is located on the other side in the first direction with respect to the second wall.

16. The image forming apparatus according to claim 12, wherein the second wall extends in the second direction, and wherein the one end, in the second direction, of the second wall is located on the one side in the second direction with respect to the other end, in the second direction, of the wall part.

17. The image forming apparatus according to claim 10, wherein the second wall extends in the second direction, and wherein the one end, in the second direction, of the second wall is arranged adjacent to the substrate arrangement part on the other side in the first direction so as to overlap the substrate arrangement part in the first direction.

18. The image forming apparatus according to claim 10, wherein the operation unit includes a rubber key made of rubber and having a plurality of buttons, and wherein the rubber key has a planar part arranged adjacent to and above the substrate and extending in the first direction and the second direction; and a peripheral wall protruding upward from a periphery of the planar part.

19. The image forming apparatus according to claim 18, wherein the panel cover includes a second drain groove overlapping the first drain groove in the vertical direction, wherein the peripheral wall includes a vent pierced in the peripheral wall in the first direction at a portion overlapping the second drain groove in the vertical direction; and an extending part extending from the vent on one side in the first direction, wherein the extending part includes:

a pair of extending side parts which extend from side ends, in the second direction, of the vent and face, in the second direction, each other with a space arranged therebetween; and an extending bottom part connected between the lower ends of the pair of extending side parts, wherein the extending side parts are arranged on the one side in the first direction with respect to the extending bottom part.

20. The image forming apparatus according to claim 19, wherein the extending bottom part is bent at the one side in the first direction and then extends downward, and wherein the lower part of the extending bottom part is arranged on the one side in the first direction with respect to the substrate with a space therebetween, the lower part of the extending bottom part being substantially overlap the lower surface of the substrate when viewed from the first direction.

* * * * *